US012060631B2

(12) United States Patent
Abukawa et al.

(10) Patent No.: US 12,060,631 B2
(45) Date of Patent: Aug. 13, 2024

(54) HOT-ROLLED STEEL SHEET

(71) Applicant: NIPPON STEEL CORPORATION, Tokyo (JP)

(72) Inventors: Genki Abukawa, Tokyo (JP); Shohei Yabu, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/293,010

(22) PCT Filed: Nov. 20, 2019

(86) PCT No.: PCT/JP2019/045340

§ 371 (c)(1),
(2) Date: May 11, 2021

(87) PCT Pub. No.: WO2020/110843

PCT Pub. Date: Jun. 4, 2020

(65) Prior Publication Data

US 2021/0404040 A1 Dec. 30, 2021

(30) Foreign Application Priority Data

Nov. 28, 2018 (JP) ..... 2018-222297

(51) Int. Cl.
*C22C 38/58* (2006.01)
*C21D 8/02* (2006.01)
(Continued)

(52) U.S. Cl.
CPC ..... *C22C 38/58* (2013.01); *C21D 8/0205* (2013.01); *C21D 8/0226* (2013.01);
(Continued)

(58) Field of Classification Search
CPC ..... C21D 8/0226
See application file for complete search history.

(56) References Cited

U.S. PATENT DOCUMENTS

2010/0047617 A1 2/2010 Sugiura et al.
2013/0167985 A1 7/2013 Saito et al.
(Continued)

FOREIGN PATENT DOCUMENTS

CN 103459648 A 12/2013
CN 103582427 A 2/2014
(Continued)

OTHER PUBLICATIONS

JIS Z 2241 (2011), "Metallic materials—Tensile testing—Method of test at room temperature", total of 37 pages.
(Continued)

*Primary Examiner* — Nicholas A Wang
(74) *Attorney, Agent, or Firm* — Birch, Stewart, Kolasch & Birch, LLP

(57) ABSTRACT

A hot-rolled steel sheet includes, as chemical composition, C, Si, Mn, and sol.Al. In the hot-rolled steel sheet, a sum of an average of pole densities in a crystal orientation group consisting of {211}<111> to {111}<112> and a pole density in a crystal orientation of {110}<001> is 0.5 to 6.0 in the surface region, and the tensile strength is 780 to 1370 MPa.

4 Claims, 1 Drawing Sheet

(51) Int. Cl.

| | |
|---|---|
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/52*** | (2006.01) |
| ***C22C 38/54*** | (2006.01) |

(52) U.S. Cl.

CPC ..... *C22C 38/002* (2013.01); *C22C 38/005* (2013.01); *C22C 38/02* (2013.01); *C22C 38/06* (2013.01); *C22C 38/42* (2013.01); *C22C 38/44* (2013.01); *C22C 38/46* (2013.01); *C22C 38/52* (2013.01); *C22C 38/54* (2013.01)

(56) References Cited

U.S. PATENT DOCUMENTS

| | | | | |
|---|---|---|---|---|
| 2013/0323112 | A1 | 12/2013 | Okamoto et al. | |
| 2014/0014237 | A1 | 1/2014 | Yokoi et al. | |
| 2014/0087208 | A1 | 3/2014 | Toda et al. | |
| 2014/0110022 | A1* | 4/2014 | Sano | C22C 38/04 148/333 |
| 2017/0044638 | A1* | 2/2017 | Yokoi | C23C 2/285 |

FOREIGN PATENT DOCUMENTS

| | | | |
|---|---|---|---|
| JP | 2007-46146 | A | 2/2007 |
| JP | 2008-274395 | A | 11/2008 |
| JP | 2012-62558 | A | 3/2012 |
| JP | 2012-77336 | A | 4/2012 |
| JP | 2013-133499 | A | 7/2013 |
| JP | 2017-57472 | A | 3/2017 |
| JP | 2017-206764 | A | 11/2017 |
| KR | 10-1632778 | B1 | 6/2016 |
| WO | WO 2012/121219 | A1 | 9/2012 |
| WO | WO 2015/162932 | A1 | 10/2015 |

OTHER PUBLICATIONS

JIS Z 2248 (2006), "Metallic materials—Bend test", total of 9 pages.

JIS Z 2248 (2014), "Metallic materials—Bend test (Amendment 1)", total of 1 page.

Kazumasa Yamazaki et al., "Influence of Microstructure on Bendability of Ultrahigh-Strength Steel Sheet—Formability of Ultrahigh-Strength Steel Sheet-", Journal of the Japan Society for Technology of Plasticity, vol. 36, (1995), No. 416, p. 973, total of 4 pages.

* cited by examiner

HOT-ROLLED STEEL SHEET

TECHNICAL FIELD OF THE INVENTION

The present invention relates to a high strength hot-rolled steel sheet having excellent bending workability.

Priority is claimed on Japanese Patent Application No. 2018-222297, filed in Japan on Nov. 28, 2018, and the content of which is incorporated herein by reference.

RELATED ART

There has been a demand for both improving fuel efficiency of vehicles and securing collision safety, the high-strengthening of steel sheets for vehicles has been promoted, and high strength steel sheets have often been used for vehicle bodies.

A hot-rolled steel sheet manufactured by hot rolling has been widely used for a material for a structural member for vehicles and industrial equipment as a relatively cheap structural material. Particularly, from the viewpoint of weight reduction, durability, shock absorption properties, and the like, high-strengthening of a hot-rolled steel sheet used for a vehicle suspension component, a bumper component, a shock absorption member, or the like has been promoted, and at the same time, excellent formability that can withstand forming into a complicated shape has also been required.

However, since the formability of the hot-rolled steel sheet tends to decrease with high-strengthening of the material, it is a difficult problem to achieve both high strength and good formability.

Particularly, in recent years, there has been an increasing demand for weight reduction of a vehicle suspension component, and it has been an important problem to realize a high tensile strength of 780 MPa or more and excellent bending workability.

For example, in Non-Patent Document 1, it is reported that bending workability is improved by controlling the structure to a single structure of ferrite, bainite, martensite, and the like by microstructure control.

Patent Document 1 discloses a method for realizing a tensile strength of 590 MPa or more and 750 MPa or less and excellent bending workability by containing, by mass %, 0.010 to 0.055% of C, 0.2% or less of Si, 0.7% or less of Mn, 0.025% or less of P, 0.02% or less of S, 0.01% or less of N, 0.1% or less of Al, and 0.06 to 0.095% of Ti, controlling the structure to a structure including ferrite at an area ratio of 95% or more, and controlling the structure to a structure in which only carbide particle containing Ti and TiS having an average diameter of 0.5 μm or less as sulfide containing Ti are dispersed and precipitated in the ferrite grains.

Patent Document 2 discloses a method for improving bending workability while maintaining a tensile strength of 780 MPa or more by containing, by mass %, 0.05 to 0.15% of C, 0.2 to 1.2% of Si, 1.0 to 2.0% of Mn, 0.04% or less of P, 0.0030% or less of S, 0.005 to 0.10% of Al, 0.005% or less of N, and 0.03 to 0.13% of Ti, controlling the structure inside the steel sheet to a bainite single phase or a structure including bainite at a fraction of more than 95%, and setting the fraction of a bainite phase to less than 80% and the fraction of ferrite rich in workability to 10% or more in the structure of the sheet surface layer area.

Patent Document 3 discloses a high strength hot-rolled steel sheet having a high yield strength of 960 MPa or more, excellent bending workability, and excellent low temperature toughness obtained by containing, by mass %, 0.08 to 0.25% of C, 0.01 to 1.0% of Si, 0.8 to 1.5% of Mn, 0.025% or less of P, 0.005% or less of S, 0.005 to 0.10% of Al, 0.001 to 0.05% of Nb, 0.001 to 0.05% of Ti, 0.1 to 1.0% of Mo, and 0.1 to 1.0% of Cr and controlling the structure to a structure in which a tempered martensite phase is a primary phase with a volume percentage of 90% or more, and the anisotropy of prior γ grains in which an average grain size of prior austenite grains is 20 μm or less in a cross section parallel to a rolling direction, and the average grain size of prior austenite grains is 15 μm or less in a cross section orthogonal to the rolling direction is reduced.

Patent Document 4 discloses a hot-rolled steel sheet having excellent local deformability and small anisotropy in bending workability obtained by controlling the pole density of each orientation of a specific crystal orientation group at the central portion in a sheet thickness direction, which is from the sheet surface to ⅝ to ⅜ of a sheet thickness, and setting rC, which is the Lankford value in a direction perpendicular to a rolling direction, to 0.70 or more and 1.10 or less and r30, which is the Lankford value in a direction at an angle of 30° to the rolling direction, to 0.70 or more and 1.10 or less.

PRIOR ART DOCUMENT

Patent Document

[Patent Document 1] Japanese Unexamined Patent Application, First Publication No. 2013-133499

[Patent Document 2] Japanese Unexamined Patent Application, First Publication No. 2012-62558

[Patent Document 3] Japanese Unexamined Patent Application, First Publication No. 2012-77336

[Patent Document 4] PCT International Publication No. WO 2012/121219

Non-Patent Document

[Non-Patent Document 1] Journal of the Japan Society for Technology of Plasticity, vol. 36 (1995), No. 416, p. 973

DISCLOSURE OF THE INVENTION

Problems to be Solved by the Invention

As described above, it is currently required to increase the strength of a steel sheet and further improve bending workability. However, with the techniques in Patent Documents 1 to 4 described above, it cannot be said that the improvement of both strength and bending workability is sufficient. An object of the present invention is to provide a high strength hot-rolled steel sheet having excellent bending workability.

The above-mentioned bending workability is an index indicating that cracks are unlikely to initiate at deformed part when being bended or an index indicating that cracks are unlikely to propagate. Specifically, in the present invention, unlike the conventional techniques, cracks (inner bending cracks) initiated from an inner face of the deformed part when being bended are targeted as described in detail later.

Means for Solving the Problem

An aspect of the present invention employs the following.

(1) A hot-rolled steel sheet according to an aspect of the present invention includes, as a chemical composition, by mass %, 0.030 to 0.400% of C, 0.050 to 2.5% of Si, 1.00 to 4.00% of Mn, 0.001 to 2.0% of sol.Al, 0 to 0.20% of Ti, 0 to 0.20% of Nb, 0 to 0.010% of B, 0 to 1.0% of V, 0 to 1.0% of Cr, 0 to 1.0% of Mo, 0 to 1.0% of Cu, 0 to 1.0% of Co, 0 to 1.0% of W, 0 to 1.0% of Ni, 0 to 0.01% of Ca, 0 to 0.01% of Mg, 0 to 0.01% of REM, 0 to 0.01% of Zr, limited to 0.020% or less of P, limited to 0.020% or less of S, limited to 0.010% or less of N, and a balance consisting of Fe and impurities, in which, when a surface region is from a sheet surface to 1/10 of a sheet thickness, a sum of an average of pole densities in a crystal orientation group consisting of {211}<111> to {111}<112> and a pole density in a crystal orientation of {110}<001> is 0.5 to 6.0 in the surface region, and a tensile strength is 780 to 1370 MPa.

(2) In the hot-rolled steel sheet according to (1), when an internal region is from 1/8 to 3/8 of the sheet thickness based on the sheet surface, a sum of a pole density in a crystal orientation of {332}<113> and a pole density in a crystal orientation of {110}<001> may be 1.0 to 7.0 in the internal region.

(3) In the hot-rolled steel sheet according to (1) or (2), the hot-rolled steel sheet may include, as the chemical composition, by mass %, at least one selected from a group consisting of 0.001 to 0.20% of Ti, 0.001 to 0.20% of Nb, 0.001 to 0.010% of B, 0.005 to 1.0% of V, 0.005 to 1.0% of Cr, 0.005 to 1.0% of Mo, 0.005 to 1.0% of Cu, 0.005 to 1.0% of Co, 0.005 to 1.0% of W, 0.005 to 1.0% of Ni, 0.0003 to 0.01% of Ca, 0.0003 to 0.01% of Mg, 0.0003 to 0.01% of REM, and 0.0003 to 0.01% of Zr.

Effects of the Invention

According to the above aspects of the present invention, it is possible to obtain a hot-rolled steel sheet having a tensile strength (maximum tensile strength) of 780 MPa or more and excellent bending workability in which the initiation of inner bending crack is suppressed.

EMBODIMENTS OF THE INVENTION

Figure 1:
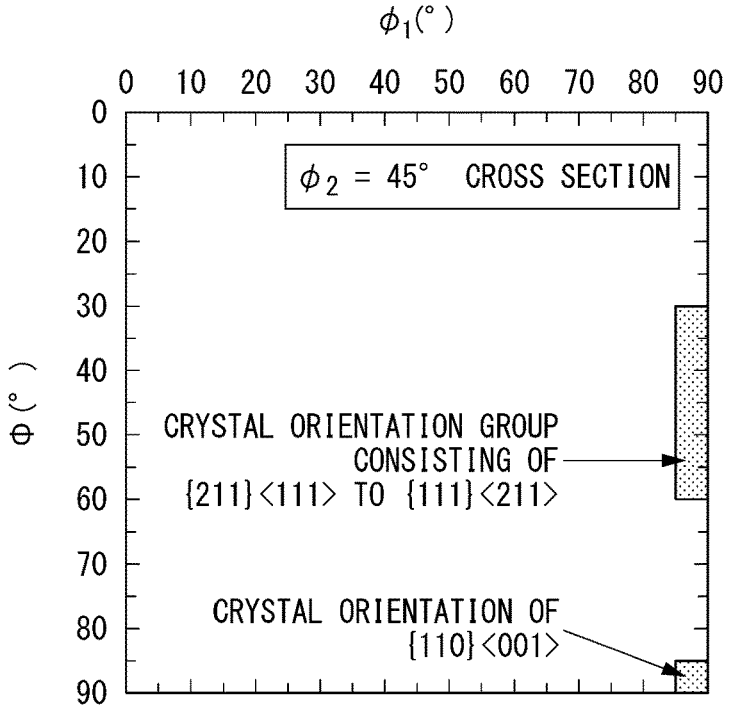
FIG. 1 is a diagram showing crystallite orientation distribution functions (ODF) at a φ2=45° cross section and showing a crystal orientation group consisting of {211}<111> to {111}<112> and a crystal orientation of {110}<001>.

Hereinafter, a hot-rolled steel sheet according to an embodiment of the present invention is described in detail. However, the present invention is not limited only to the configuration which is disclosed in the embodiment, and various modifications are possible without departing from the aspect of the present invention. In addition, the limitation range as described below includes a lower limit and an upper limit thereof. However, the value expressed by "more than" or "less than" does not include in the limitation range. "%" of the amount of respective elements expresses "mass %".

First, the background leading to the idea of the hot-rolled steel sheet according to the embodiment will be described.

Conventionally, when a steel sheet is subjected to bending, cracks generally initiate from near an outer face or an edge face of deformed part of the steel sheet. The present inventors have made a thorough investigation about the bending workability of high strength steel sheet, and as a results, it has been found that, with increasing the strength of steel sheet, cracks tend to initiate from an inner face of the deformed part when being bended (hereinafter, it may be referred to as inner bending crack). The above inner bending crack has not been investigated in the past.

The initiation mechanism of the inner bending crack is presumed as follows. The compressive stress is applied to the inner face when being bended. At first, the deformation proceeds by uniformly deforming the entire inner bended face. When the amount of deformation becomes large, the deformation cannot proceed only by the uniform deformation, and thus, the deformation proceeds by locally concentrating the strain (formation of shear band). When the shear band is formed excessively, cracks along the shear band initiate and propagate from the inner bended face.

The reason why the inner bending crack tends to initiate as increasing the strength of steel sheet is presumed as follows. The work hardenability decreases with increasing the strength of steel sheet, the uniform deformation becomes difficult to proceed, the deformation tends to locally concentrate, and thus, the shear band tends to be formed at early stage of deformation (or even when the deformation is small).

According to the investigation by the present inventors, it has been found that the inner bending crack is easily formed in the steel sheet with tensile strength of 780 MPa or more, further in the steel sheet with tensile strength of 980 MPa or more, and furthermore in the steel sheet with tensile strength of 1180 MPa or more.

The present inventors have investigated a method for suppressing inner bending crack focusing on the texture, based on the above initiation mechanism of the inner bending crack (the initiation and propagation of the inner bending crack along the shear band).

When the steel sheet is deformed, the easiness to activate the slip system due to the deformation differs depending on each crystal orientation (Schmid factor). Specifically, it seems that the deformation resistance differs depending on each crystal orientation. When the texture is comparatively random, the deformation resistance is uniform, and thus, the deformation tends to occur uniformly. On the other hand, when the texture develops specifically, the deformation occurs unevenly between the crystals whose orientations have large deformation resistance and the other crystals, and thus, the shear band tends to be formed.

On the contrary, when the existence ratio of the grains whose orientations have large deformation resistance is reduced, the deformation occurs uniformly, and thus, the shear band becomes difficult to be formed. Specifically, the inner bending crack may be suppressed. Based on the idea, the present inventors have made a thorough investigation about the relationship between the texture of hot-rolled steel sheet and the inner bending crack. As a results, it has been found that the inner bending crack can be suppressed by controlling a specific texture which tends to be developed in the hot-rolled steel sheet.

Particularly, as a result of the intensive investigation conducted by the present inventors, it has been found that the texture of the sheet surface region affects the formation of cracks during bending deformation. Further, it has been found that the texture of the internal region which is from 1/8 to 3/8 of the sheet thickness affects the propagation of cracks initiated in the surface region.

Based on the above findings, the present inventors have found that a hot-rolled steel sheet where the formation of inner bending crack is suppressed can be realized by controlling the texture formed in the sheet surface region in the finish rolling of hot rolling to reduce the existence ratio of the grains whose orientations have large deformation resistance. In addition, it has been found that the propagation of inner bending crack can be further preferably suppressed by controlling the texture of the sheet internal region in addition to controlling the texture of the sheet surface region.

Specifically, the worked structure in the sheet surface region is controlled by controlling the steel composition within an appropriate range, controlling the sheet thickness and the temperature at the time of hot rolling, controlling the sheet thickness, the roll shape ratio, the rolling reduction, and the temperature in the last two stages of rolling at the time of finish rolling of hot rolling which have not been positively controlled in the related art, and additionally, controlling the total rolling reduction in the last three stages of rolling at the time of finish rolling of hot rolling. As a result, it has been found that the formation of inner bending crack can be suppressed since recrystallization is controlled and the texture of the sheet surface region is optimized.

Further, it has been found that in addition to the optimization of the texture of the sheet surface region, the worked structure of the sheet internal region is controlled by preferably controlling the finish rolling conditions of hot rolling, and as a result, as long as the texture of the sheet internal region is optimized, the propagation of inner bending crack is further preferably suppressed.

A hot-rolled steel sheet according to the embodiment includes, as a chemical composition, by mass %, 0.030 to 0.400% of C, 0.050 to 2.5% of Si, 1.00 to 4.00% of Mn, 0.001 to 2.0% of sol.Al, 0 to 0.20% of Ti, 0 to 0.20% of Nb, 0 to 0.010% of B, 0 to 1.0% of V, 0 to 1.0% of Cr, 0 to 1.0% of Mo, 0 to 1.0% of Cu, 0 to 1.0% of Co, 0 to 1.0% of W, 0 to 1.0% of Ni, 0 to 0.01% of Ca, 0 to 0.01% of Mg, 0 to 0.01% of REM, 0 to 0.01% of Zr, limited to 0.020% or less of P, limited to 0.020% or less of S, limited to 0.010% or less of N, and a balance consisting of Fe and impurities. In addition, in the hot-rolled steel sheet according to the embodiment, when a surface region is from a sheet surface to 1/10 of a sheet thickness, a sum of an average of pole densities in a crystal orientation group consisting of {211}<111> to {111}<112> and a pole density in a crystal orientation of {110}<001> is 0.5 to 6.0 in the surface region. In addition, in the hot-rolled steel sheet according to the embodiment, the tensile strength is 780 to 1370 MPa.

In addition, in the hot-rolled steel sheet according to the embodiment, when an internal region is from 1/8 to 3/8 of the sheet thickness based on the sheet surface, a sum of a pole density in a crystal orientation of {332}<113> and a pole density in a crystal orientation of {110}<001> is preferably 1.0 to 7.0 in the internal region.

In addition, the hot-rolled steel sheet according to the embodiment may include, as the chemical composition, by mass %, at least one selected from the group consisting of 0.001 to 0.20% of Ti, 0.001 to 0.20% of Nb, 0.001 to 0.010% of B, 0.005 to 1.0% of V, 0.005 to 1.0% of Cr, 0.005 to 1.0% of Mo, 0.005 to 1.0% of Cu, 0.005 to 1.0% of Co, 0.005 to 1.0% of W, 0.005 to 1.0% of Ni, 0.0003 to 0.01% of Ca, 0.0003 to 0.01% of Mg, 0.0003 to 0.01% of REM, and 0.0003 to 0.01% of Zr.

1. Chemical Composition

First, the steel composition and the reason for its limitation will be described. The hot-rolled steel sheet according to the embodiment includes, as the chemical composition, base elements and as required, an optional element, and the balance consists of iron and impurities.

In the chemical composition of the hot-rolled steel sheet according to the embodiment, C, Si, Mn, and Al are base elements (main alloying elements).

(C: 0.030 to 0.400%)

C (carbon) is an important element for securing the strength of the steel sheet. When the C content is less than 0.030%, a tensile strength of 780 MPa or more cannot be secured. Therefore, the C content is set to 0.030% or more and preferably 0.05% or more. On the other hand, when the C content is more than 0.400%, the weldability is deteriorated, and thus the upper limit is set to 0.400%. The C content is preferably 0.30% or less and more preferably 0.20%.

(Si: 0.050 to 2.5%)

Si (silicon) is an important element capable of increasing the material strength by solid solution strengthening. When the Si content is less than 0.050%, the yield strength is decreased, and thus the Si content is set to 0.050% or more. The Si content is preferably 0.1% or more and more preferably 0.3% or more. On the other hand, when the Si content is more than 2.5%, the surface properties are deteriorated and thus the Si content is set to 2.5% or less. The Si content is preferably 2.0% or less and more preferably 1.5% or less.

(Mn: 1.00 to 4.00%)

Mn (manganese) is an effective element for increasing the mechanical strength of the steel sheet. When the Mn content is less than 1.00%, a tensile strength of 780 MPa or more cannot be secured. Therefore, the Mn content is set to 1.00% or more. The Mn content is preferably 1.50% or more and more preferably 2.00% or more. On the other hand, when Mn is added excessively, the structure becomes non-uniform due to Mn segregation, and the bending workability is decreased. Therefore, the Mn content is set to 4.00% or less, preferably 3.00% or less, and more preferably 2.60% or less.

(sol.Al: 0.001 to 2.0%)

sol.Al (acid soluble aluminum) is an element that has an effect of deoxidizing the steel and making the steel sheet sound. When the sol.Al content is less than 0.001%, the steel cannot be sufficiently deoxidized and the sol.Al content is set to 0.001% or more. However, in a case where sufficient deoxidation is required, the sol.Al content is more desirably 0.01% or more and even more desirably 0.02% or more. On the other hand, when the sol.Al content is more than 2.0%, the weldability is significantly decreased, and the amount of oxide-based inclusions is increased, so that the surface properties are significantly deteriorated. Therefore, the sol.Al content is set to 2.0% or less, preferably 1.5% or less, more preferably 1.0% or less, and most preferably 0.08% or less. In addition, sol.Al means an acid soluble Al that does not form an oxide such as $Al_2O_3$ and is soluble in an acid.

The hot-rolled steel sheet according to the embodiment contains impurities as the chemical composition. In addition, the impurities correspond to elements which are contaminated during industrial production of steel from ores and scrap that are used as a raw material of steel, or from environment of a production process. For example, the term "impurities" means elements such as P, S, and N. These impurities are preferably limited as follows in order to fully exert the effects of the embodiment. Further, since it is preferable that the impurity content is small, it is not required to limit the lower limit, and the lower limit of impurities may be 0%.

(P: 0.020% or Less)

P (phosphorus) is an impurity generally contained in the steel. However, since P has an effect of increasing the tensile strength, P may be intentionally contained. However, when the P content is more than 0.020%, the deterioration of weldability becomes significant. Therefore, the P content is limited to 0.020% or less. The P content is preferably limited to 0.010% or less. In order to more reliably obtain the above effect, the P content may be 0.001% or more.

(S: 0.020% or Less)

S (sulfur) is an impurity contained in the steel, and the smaller the amount is, the more preferable it is from the viewpoint of weldability. When the S content is more than 0.020%, the weldability is significantly decreased, the precipitation amount of MnS is increased, and the low temperature toughness is decreased. Therefore, the S content is limited to 0.020% or less. The S content is preferably limited to 0.010% or less and more preferably 0.005% or less. From the viewpoint of desulfurization cost, the S content may be 0.001% or more.

(N: 0.010% or Less)

N (nitrogen) is an impurity contained in the steel, and the smaller the amount is, the more preferable it is from the viewpoint of weldability. When the N content is more than 0.010%, the weldability is significantly decreased. Therefore, the N content is limited to 0.010% or less. The N content is preferably limited to 0.005% or less and more preferably 0.003% or less.

The hot-rolled steel sheet according to the embodiment may contain the optional element in addition to the base elements and the impurities described above. For example, as substitution for a part of Fe which is the balance described above, as the optional element, the steel sheet may include at least one selected from a group consisting of Ti, Nb, B, V, Cr, Mo, Cu, Co, W, Ni, Ca, Mg, REM, and Zr. The optional elements preferably improve the mechanical properties of the hot-rolled steel sheet. The optional elements may be included as necessary. Thus, a lower limit of the respective optional elements does not need to be limited, and the lower limit may be 0%. Moreover, even if the optional elements may be included as impurities, the above mentioned effects are not affected.

(Ti: 0 to 0.20%)

Ti (titanium) is an element that is precipitated as TiC in the ferrite or bainite in the steel sheet structure during cooling or coiling of the steel sheet to contribute to improvement in strength. Therefore, Ti may be contained in the steel. When Ti is added excessively, recrystallization at the time of hot rolling is suppressed and the texture with a specific crystal orientation is developed. Thus, R/t, which is a value obtained by dividing the average of the minimum inner bend radius of L-axis bending and C-axis bending by the sheet thickness, is not 2.2 or less. Therefore, the Ti content is set to 0.20% or less. The Ti content is preferably 0.18% or less and more preferably 0.15% or less. In order to preferably obtain the above effect, the Ti content may be 0.001% or more. The Ti content is preferably 0.02% or more.

(Nb: 0 to 0.20%)

Similar to Ti, Nb (niobium) is an element that is precipitated as NbC to improve the strength and significantly suppress the recrystallization of austenite. Therefore, Nb may be contained in the steel. When the Nb content is more than 0.20%, the recrystallization of austenite is suppressed during hot rolling to develop the texture. Thus, R/t, which is a value obtained by dividing the average of the minimum inner bend radius of L-axis bending and C-axis bending by the sheet thickness, is not 2.2 or less. Therefore, the Nb content is set to 0.20% or less. The Nb content is preferably 0.15% or less and more preferably 0.10% or less. In order to preferably obtain the above effect, the Nb content may be 0.001% or more. The Nb content is preferably 0.005% or more.

It is preferable that the hot-rolled steel sheet according to the embodiment includes, as the chemical composition, by mass %, at least one of 0.001 to 0.20% of Ti or 0.001 to 0.20% of Nb.

(B: 0 to 0.010%)

B (boron) is segregated at the grain boundaries to improve the grain boundary strength, so that roughness of the punched cross section at the time of punching can be suppressed. Therefore, B may be contained in the steel. Even when the B content is more than 0.010%, the above effect is saturated, which is economically disadvantageous. Therefore, the upper limit of the B content is set to 0.010%. The B content is preferably 0.005% or less and more preferably 0.003% or less. In order to preferably obtain the above effect, the B content may be 0.001% or more.

(V: 0 to 1.0%)
(Cr: 0 to 1.0%)
(Mo: 0 to 1.0%)
(Cu: 0 to 1.0%)
(Co: 0 to 1.0%)
(W: 0 to 1.0%)
(Ni: 0 to 1.0%)

All of V (vanadium), Cr (chromium), Mo (molybdenum), Cu (copper), Co (cobalt), W (tungsten), and Ni (nickel) are elements effective for stably securing strength. Therefore, these elements may be contained in the steel. However, even when each of the elements is contained in an amount of more than 1.0%, the above effect is likely to be saturated, which may be economically disadvantageous. Therefore, the amount of each of these elements is set to 1.0% or less. The amount of each of these elements is preferably 0.8% or less and more preferably 0.5% or less. In addition, in order to more reliably obtain the above effect, the amount of each element may be 0.005% or more.

It is preferable that the hot-rolled steel sheet according to the embodiment includes, as the chemical composition, by mass %, at least one selected from the group consisting of 0.005 to 1.0% of V, 0.005 to 1.0% of Cr, 0.005 to 1.0% of Mo, 0.005 to 1.0% of Cu, 0.005 to 1.0% of Co, 0.005 to 1.0% of W, and 0.005 to 1.0% of Ni.

(Ca: 0 to 0.01%)
(Mg: 0 to 0.01%)
(REM: 0 to 0.01%)
(Zr: 0 to 0.01%)

All of Ca (calcium), Mg (magnesium), REM (rare earth element), and Zr (zirconium) are elements that contribute to inclusion control, particularly fine dispersion of inclusions, and enhance toughness. Therefore, these elements may be contained in the steel. However, when each of the elements is contained in an amount of more than 0.01%, deterioration of the surface properties may become apparent. Therefore, the amount of each of these elements is set to 0.01% or less. The amount of each of these elements is preferably 0.005% or less and more preferably 0.003% or less. In order to more reliably obtain the above effect, the amount of each element may be 0.0003% or more.

Here, REM refers to a total of 17 elements including Sc, Y and lanthanoids and is at least one of these elements. The REM content means the total amount of at least one of these elements. In a case where lanthanoid is used, industrially, REM is added in a Mischmetal form.

It is preferable that the hot-rolled steel sheet according to the embodiment includes, as the chemical composition, at least one selected from the group consisting of 0.0003 to 0.01% of Ca, 0.0003 to 0.01% of Mg, 0.0003 to 0.01% of REM, and 0.0003 to 0.01% of Zr.

The above-mentioned steel composition may be measured by a general method for analyzing steel. For example, the steel composition may be measured by using ICP-AES (Inductively Coupled Plasma-Atomic Emission Spectrometer: inductively coupled plasma emission spectroscopy spectrometry). The amount of sol.Al may be measured by ICP-AES using a filtrate after a sample is thermally decomposed with an acid. In addition, C and S may be measured by the infrared absorption method after combustion, N may be measured by the thermal conductometric method after fusion in a current of inert gas, and O may be measured by, for example, the non-dispersive infrared absorption method after fusion in a current of inert gas.

2. Texture

Next, the texture of the hot-rolled steel sheet according to the embodiment will be described.

The hot-rolled steel sheet according to the embodiment has a texture in which, when a surface region is from a sheet surface to 1/10 of a sheet thickness, a sum of an average of pole densities in a crystal orientation group consisting of {211}<111> to {111}<112> and a pole density in a crystal orientation of {110}<001> is 0.5 to 6.0 in the surface region.

(Surface Region from Sheet Surface to 1/10 of Sheet Thickness)

When the steel sheet is bent and deformed, the strain increases toward the surface with the center of the sheet thickness as the boundary, and the strain becomes maximum at the outermost surface. Therefore, the inner bending crack is initiated on the surface of the steel sheet. Since it is the structure of the surface region from the sheet surface to 1/10 of the sheet thickness to contribute to the initiation of cracks as described above, the texture of the surface region is controlled.

Herein, in a case of the steel sheet where the development of the texture is different on both sheet surface, the texture may satisfy the above condition in the region from the sheet surface on one side to 1/10 of the sheet thickness. It is possible to obtain the effects of the embodiment, when the bending is conducted under the condition such that the side which satisfies the texture condition becomes the inner face.

(In Surface Region, Sum of Average of Pole Densities in Crystal Orientation Group Consisting of {211}<111> to {111}<112> and Pole Density in Crystal Orientation of {110}<001> is 0.5 to 6.0)

The crystal orientation group consisting of {211}<111> to {111}<112> and the crystal orientation of {110}<001> are the orientation which easily develops in the surface region of the high strength hot-rolled steel sheet produced by a conventional method. The crystals which have the above orientations have particularly large deformation resistance at the inner face of the deformed part when being bended. Thus, the shear band tends to be formed because of the difference of deformation resistance between the crystals which have the above orientations and the other crystals. Therefore, by reducing the pole densities of the above orientations, the inner bending crack can be suppressed. However, even when only one of the average of pole densities in the crystal orientation group consisting of {211}<111> to {111}<112> and the pole density in the crystal orientation of {110}<001> is reduced, the effects of the embodiment is not obtained. Thus, it is important to reduce the sum thereof.

When the sum of the average of pole densities in the crystal orientation group consisting of {211}<111> to {111}<112> and the pole density in the crystal orientation of {110}<001> is more than 6.0 in the surface region which is from the sheet surface to 1/10 of the sheet thickness, the shear band tends to be easily formed, the inner bending crack tends to be initiated, and thus, R/t which is the value obtained by dividing the average of the minimum inner bend radius of L-axis bending and C-axis bending by the sheet thickness is not 2.2 or less. Therefore, the sum thereof is to be 6.0 or less. The sum is preferably 5.0 or less, and more preferably 4.0 or less.

The smaller the sum of the average of pole densities in the crystal orientation group consisting of {211}<111> to {111}<112> and the pole density in the crystal orientation of {110}<001> is, the more preferable it is. However, in a high strength hot-rolled steel sheet having a tensile strength of 780 MPa or more, it is difficult to set the value to less than 0.5, and thus the lower limit is practically 0.5.

The hot-rolled steel sheet according to the embodiment preferably has a texture in which the sum of the pole density in the crystal orientation of {332}<113> and the pole density in the crystal orientation of {110}<001> is 1.0 to 7.0 in the internal region which is from 1/8 to 3/8 of the sheet thickness based on the sheet surface.

(Internal Region from 1/8 to 3/8 of Sheet Thickness Based on Sheet Surface)

When the inner bending cracks are initiated in the surface region by deforming the steel sheet by bending, the inner bending cracks may be propagated toward the internal region of the sheet thickness. Since the internal region from 1/8 to 3/8 of the sheet thickness based on the sheet surface mainly contributes to such progress of inner bending cracks, it is preferable to control the texture of this region.

(In Internal Region, Sum of Pole Density in Crystal Orientation of {332}<113> and Pole Density in Crystal Orientation of {110}<001> is 1.0 to 7.0)

The crystal orientation of {332}<113> and the crystal orientation of {110}<001> are the orientation which easily develops in the internal region which is from 1/8 to 3/8 of the sheet thickness of the high strength hot-rolled steel sheet produced by a conventional method. The crystals which have the above orientations may have particularly large deformation resistance at the inner face of the deformed part when being bended. Thus, the inner bending crack which is initiated in the surface region tends to be propagated toward the internal region because of the difference of deformation resistance between the crystals which have the above orientations and the other crystals. Therefore, by reducing the pole densities of the above orientations in the internal region in addition to controlling the texture in the surface region, the inner bending crack can be suppressed. However, even when only one of the pole density in the crystal orientation of {332}<113> and the pole density in the crystal orientation of {110}<001> is reduced, the effects of the embodiment is not obtained. Thus, it is important to reduce the sum thereof.

When the sum of the pole density in the crystal orientation of {332}<113> and the pole density in the crystal orientation of {110}<001> is controlled to be 7.0 or less in the internal region which is from 1/8 to 3/8 of the sheet thickness, it is possible to preferably suppress the inner bending crack. When the sum of the above the pole densities is 7.0 or less in addition to controlling the crystal orientations in the surface region to be predetermined range, R/t which is a value obtained by dividing the average of the minimum inner bend radius of L-axis bending and C-axis bending by the sheet thickness satisfies 1.8 or less. The sum of the above the pole densities is preferably 6.0 or less, and more preferably 5.0 or less.

The smaller the sum of the pole density in the crystal orientation of {332}<113> and the pole density in the crystal orientation of {110}<001> is, the more preferable it is.

However, in a high strength hot-rolled steel sheet having a tensile strength of 780 MPa or more, it is difficult to set the value to less than 1.0, and thus the lower limit is practically 1.0.

The pole density can be measured by an electron backscatter diffraction pattern (EBSP) method. In a sample to be subjected to analysis by the EBSP method, a cut surface parallel to the rolling direction and perpendicular to the sheet surface is mechanically polished and then strain is removed by chemical polishing or electrolytic polishing. This sample is used to perform analysis by the EBSP method such that the measurement interval is set to 4 μm and the measurement area is set to 150000 $\mu m^2$ or more in a range from the sheet surface to 1/10 of the sheet thickness or as required, in a range from 1/8 to 3/8 of the sheet thickness.

FIG. 1 shows crystallite orientation distribution functions (ODF) at a φ2=45° cross section, a crystal orientation group consisting of {211}<111> to {111}<112>, and a crystal orientation of {110}<001>. The crystal orientation group consisting of {211}<111> to {111}<112> refers to a range of φ1=85° to 90°, Φ=30° to 60°, φ2=45° in the Bunge notation of texture analysis using crystallite orientation distribution functions (ODF) at a φ2=45° cross section. The average of pole densities in the crystal orientation group is calculated in the above range shown in FIG. 1. Herein, to be exact, the crystal orientation group consisting of {211}<111> to {111}<112> corresponds to a range of φ1=90°, Φ=30° to 60°, φ2=45° on the ODF. However, since there is a measurement error due to test piece working and sample setting, in the hot-rolled steel sheet according to the embodiment, the average of pole densities is calculated in the range of φ1=85° to 90°, Φ=30° to 60°, φ2=45°.

In the same way, the crystal orientation of {110}<001> refers to a range of φ1=85° to 90°, Φ=85° to 90°, φ2=45° in the crystallite orientation distribution functions (ODF) at the φ2=45° cross section. The pole density in the crystal orientation is calculated in the above range shown in FIG. 1.

Here, for the crystal orientation of the rolled sheet, a lattice plane parallel to the sheet surface is usually expressed by (hkl) or {hkl}, and an orientation parallel to the rolling direction is expressed by [uvw] or <uvw>. Note that {hkl} and <uvw> are general terms for equivalent lattice planes and directions, and (uvw) and [hkl] refer to individual lattice planes and directions. That is, in the hot-rolled steel sheet according to the embodiment, the bcc structure is covered, and thus, for example, (110), (−110), (1−10), (−1−10), (101), (−101), (10−1), (−10−1), (011), (0−11), (01−1), and (0−1−1) are equivalent lattice planes and cannot be distinguished. In this case, these lattice planes are collectively referred to as {110}.

Figure 2:
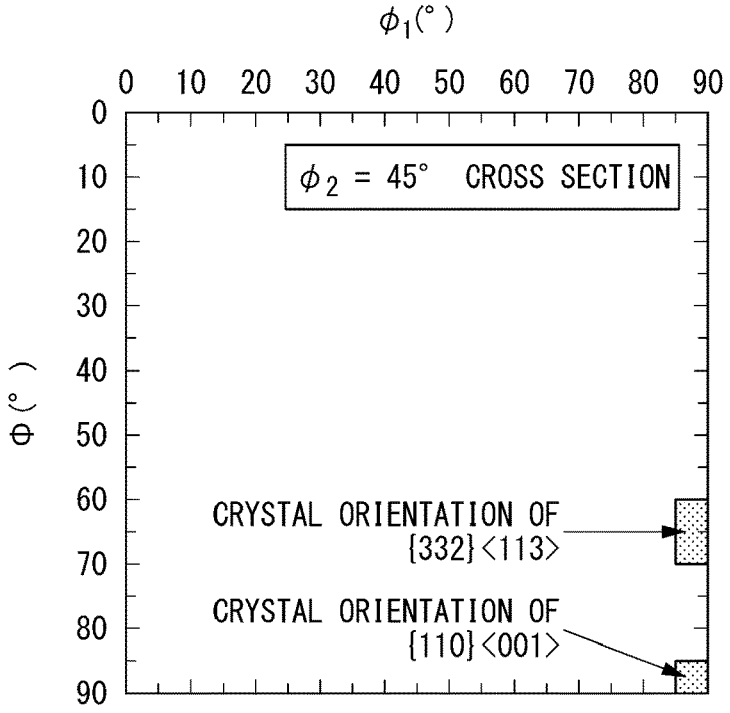
FIG. 2 is a diagram showing crystallite orientation distribution functions (ODF) at a φ2=45° cross section and showing a crystal orientation of {332}<113> and a crystal orientation of {110}<001>.

FIG. 2 shows crystallite orientation distribution functions (ODF) at a φ2=45° cross section, a crystal orientation of {332}<113>, and a crystal orientation of {110}<001>. The crystal orientation of {332}<113> refers to a range of φ1=85° to 90°, Φ=60° to 70°, φ2=45° in the Bunge notation of texture analysis using crystallite orientation distribution functions (ODF) at a φ2=45° cross section. The pole density in the crystal orientation is calculated in the above range shown in FIG. 2.

In the same way, the crystal orientation of {110}<001> refers to a range of φ1=85° to 90°, Φ=85° to 90°, φ2=45° in the crystallite orientation distribution functions (ODF) at the φ2=45° cross section. The pole density in the crystal orientation is calculated in the above range shown in FIG. 2.

3. Steel Sheet Structure

In the hot-rolled steel sheet according to the embodiment, the texture may be controlled as described above, and the constituent phase of the steel structure is not particularly limited.

However, the hot-rolled steel sheet according to the embodiment may contain, as a constituent phase of the steel structure, ferrite, bainite, fresh martensite, tempered martensite, pearlite, or residual austenite, and may contain a compound such as carbonitride in the structure.

For example, it is preferable that the steel sheet includes, by area %, 0 to 70% of ferrite, 0 to 100% of bainite and tempered martensite in total (may be a bainite and tempered martensite single structure), 25% or less of residual austenite, 0 to 100% of fresh martensite (may be a martensite single structure), and 5% or less of pearlite. It is preferable that the balance excluding the above constituent phase is limited to 5% or less.

4. Mechanical Properties

Next, the mechanical properties of the hot-rolled steel sheet according to the embodiment will be described.

(Tensile Strength is 780 to 1370 MPa)

It is preferable that the hot-rolled steel sheet according to the embodiment has sufficient strength to contribute to weight reduction of vehicles. Therefore, the maximum tensile strength (TS) is set to 780 MPa or more. The maximum tensile strength is preferably 980 MPa or more. The upper limit of the maximum tensile strength does not need to be set in particular, but for example, this upper limit may be set to 1370 MPa. In addition, the hot-rolled steel sheet according to the embodiment preferably has a total elongation (EL) of 7% or more. The tensile test may be performed according to JIS Z2241 (2011).

Since the hot-rolled steel sheet according to the embodiment satisfies the above-mentioned steel composition, texture, and tensile strength, R/t which is a value obtained by dividing the average of the minimum inner bend radius of L-axis bending and C-axis bending by the sheet thickness is 2.2 or less.

Herein, R represents the minimum bend radius of the inner bending crack, and t represents the thickness of the hot-rolled steel sheet. For example, the bending test may be performed according to JIS Z 2248 (2014) (V block 90° bending test) for both bending (L-axis bending) where the bending ridge is parallel to the rolling direction (L direction) and bending (C-axis bending) where the bending ridge is parallel to the direction perpendicular to the rolling direction (C direction) by cutting out a strip-shaped test piece from a ½ position in the width direction of the hot-rolled steel sheet. Whether or not a crack is initiated on the inner face of the bending is investigated, and the minimum inner bend radius R at which the crack is not initiated is obtained.

5. Manufacturing Method

Next, a preferable method for manufacturing the hot-rolled steel sheet according to the embodiment will be described.

The method for manufacturing the hot-rolled steel sheet according to the embodiment is not limited to the following method. The following manufacturing method is an example for manufacturing the hot-rolled steel sheet according to the embodiment.

It is important to suppress the initiation of cracks by controlling the texture of the sheet surface region of the inner face that undergoes the most severe bending deformation when being bended in order to obtain excellent bending workability. Further, it is desirable that minute cracks initiated on the sheet surface region are not propagated to the inside by reducing the pole density in a predetermined orientation of the internal region. The manufacturing conditions for satisfying these conditions are shown below.

The manufacturing step performed before hot rolling is not particularly limited. That is, various secondary smelting may be performed subsequent to melting by a blast furnace or an electric furnace, and then casting may be performed by a method such as ordinary continuous casting, casting by an ingot method, thin slab casting, or the like. In a case of continuous casting, a cast slab may be cooled to a low temperature, then heated again and then hot-rolled, or a cast slab may be hot-rolled as it is after casting without being cooled to a low temperature. Scrap may be used as a raw material.

The cast slab is heated. In this heating step, the slab is heated to a temperature of 1200° C. to 1300° C., and then retained for 30 minutes or longer. Since Ti and Nb-based precipitates are not sufficiently dissolved at a heating temperature lower than 1200° C., sufficient precipitation hardening cannot be obtained during hot rolling in the subsequent step, and the precipitates remain in the steel as coarse carbides. Thus, formability is deteriorated. Therefore, the heating temperature of the slab is set to 1200° C. or higher. On the other hand, since the amount of scale generated is increased and the yield is decreased at a heating temperature higher than 1300° C., the heating temperature is set to 1300° C. or lower. In order to sufficiently dissolve the Ti and Nb-based precipitates, it is preferable to retain the steel sheet in this temperature range for 30 minutes or longer. In addition, in order to suppress excessive scale loss, the retention time is preferably 10 hours or shorter and more preferably 5 hours or shorter.

The heated slab is subjected to rough rolling. In the rough rolling step, the thickness of the rough-rolled sheet after rough rolling is controlled to more than 35 mm and 45 mm or less. The thickness of the rough-rolled sheet affects the amount of temperature decrease from the tip end to the tail end of the rolled sheet that occurs from the start of rolling to the completion of rolling in a finish rolling step. In addition, when the thickness of the rough-rolled sheet is 35 mm or less or more than 45 mm, the amount of strain introduced into the steel sheet during the finish rolling, which is the next step, is changed, and the worked structure formed during the finish rolling is changed. As a result, the recrystallization behavior is changed and thus it difficult to obtain a desired texture. In particular, it becomes difficult to obtain the above-mentioned texture in the sheet surface region.

The rough-rolled sheet is subjected to finish rolling. In this finish rolling step, multi-stage finish rolling is performed. The finish rolling start temperature is 1000° C. to 1150° C., and the thickness of the steel sheet (thickness of the rough-rolled sheet) before the start of finish rolling is more than 35 mm and 45 mm or less. In addition, in the rolling one step before the final stage of the multi-stage finish rolling, the rolling temperature is 960° C. to 1020° C. and the rolling reduction is more than 11% and 23% or lower. Further, in the final stage of the multi-stage finish rolling, the rolling temperature is 930° C. to 995° C., and the rolling reduction is more than 11% and 22% or lower. In addition, each condition at the time of the last two stages of rolling is controlled, and a texture forming parameter ω calculated by Equation 1 below satisfies 110 or less. In addition, the total rolling reduction in the last three stages of the multi-stage finish rolling is 35% or more. Finish rolling is performed under the above conditions.

[Equation 1]

$$\omega = 0.3\left[\frac{\{1.2\times10^4/F_1^* + 600(Sr_1 - 0.9)\}}{FT_1^*} + \frac{\{800/F_2^* + 400(Sr_2 - 0.9)\}}{FT_2^*}\right] \quad \text{(Equation 1)}$$

[Equation 2]

$$PE = \begin{cases} 0.01 & (Ti + 13Nb < 0.02) \\ Ti + 1.3Nb - 0.01 & (Ti + 1.3Nb \geq 0.02) \end{cases} \quad \text{(Equation 2)}$$

[Equation 3]

$$F_1^* = \begin{cases} 1.0 & (F_1 < 12) \\ F_1 - 11 & (F_1 \geq 12) \end{cases} \quad \text{(Equation 3)}$$

[Equation 4]

$$F_2^* = \begin{cases} 0.1 & (F_2 < 11.1) \\ F_2 - 11 & (F_2 \geq 11.1) \end{cases} \quad \text{(Equation 4)}$$

[Equation 5]

$$Sr_1 = \frac{\sqrt{\frac{1}{2}D_1 \times (t_1 - t_2)}}{\left(\frac{1}{3}(t_1 + 2t_2)\right)} \quad \text{(Equation 5)}$$

[Equation 6]

$$Sr_2 = \frac{\sqrt{\frac{1}{2}D_2 \times (t_2 - t_f)}}{\left(\frac{1}{3}(t_2 + 2t_f)\right)} \quad \text{(Equation 6)}$$

[Equation 7]

$$FT_1^* = \frac{(FT_1 - 910)}{10PE} \quad \text{(Equation 7)}$$

[Equation 8]

$$FT_2^* = \frac{(FT_2 - 928)}{20PE} \quad \text{(Equation 8)}$$

Here,

PE: conversion value of recrystallization suppression effect by a precipitate forming element (unit: mass %), Ti: concentration of Ti contained in the steel (unit: mass %), Nb: concentration of Nb contained in the steel (unit: mass %), $F_1$*: converted rolling reduction in one stage before the final stage (unit: %), $F_2$*: converted rolling reduction in the final stage (unit: %), $F_1$: rolling reduction in one stage before the final stage (unit: %), $F_2$: rolling reduction in the final stage (unit: %), $Sr_1$: rolled shape ratio in one stage before the final stage (no unit), $Sr_2$: rolled shape ratio in the final stage (no unit), $D_1$: roll diameter in one stage before the final stage (unit: mm), $D_2$: roll diameter in the final stage (unit: mm), $t_1$: sheet thickness at the start of rolling in one stage before the final stage (unit: mm), $t_2$: sheet thickness at the start of rolling in the final stage (unit: mm), $t_f$: sheet thickness after finish rolling (unit: mm), $FT_1$*: converted rolling temperature in one stage before the final stage (unit: ° C.), $FT_2$*: converted rolling temperature in the final stage (unit: ° C.), $FT_1$: rolling temperature in one stage before the final stage (unit: ° C.), and $FT_2$: rolling temperature in the final stage (unit: ° C.).

However, in Equations 1 to 8, regarding the numbers such as 1 and 2 that are appended to variables as $F_1$ and $F_2$, in the last two stages of rolling in the multi-stage finish rolling, 1 is added to the variable related to rolling in one stage before the final stage, and 2 is added to the variable related to rolling in the final stage. For example, in multi-stage finish rolling including seven stages of rolling in total, $F_1$ means the rolling reduction in the sixth stage counting from the rolling inlet side, and $F_2$ means the rolling reduction in the seventh stage.

Regarding the conversion value PE of the recrystallization suppression effect by a precipitate forming element, the austenite pinning effect and the solute drug effect become apparent when the value of Ti+1.3 Nb is 0.02 or more. Thus, in Equation 2, in a case where Ti+1.3Nb<0.02 is satisfied, PE=0.01, and in a case where Ti+1.3Nb≥0.02 is satisfied, PE=Ti+1.3Nb−0.01.

Regarding the converted rolling reduction $F_1$* in one stage before the final stage, the effect of the rolling reduction $F_1$ in one stage before the final stage on the texture becomes apparent when the value of $F_1$ is 12 or more. Thus, in Equation 3, in a case where $F_1$<12 is satisfied, $F_1$*=1.0, and in a case where $F_1$≥12 is satisfied, $F_1$*=$F_1$−11.

Regarding the converted rolling reduction $F_2$* in the final stage, the effect of the rolling reduction $F_2$ in the final stage on the texture becomes apparent when the value of $F_2$ is 11.1 or more. Thus, in Equation 4, in a case where $F_2$<11.1 is satisfied, $F_2$*=0.1, and in a case where $F_2$≥11.1 is satisfied, $F_2$*=$F_2$−11.

Equation 1 shows preferable manufacturing conditions in finish rolling in which the rolling temperature $FT_2$ in the final stage is 930° C. or higher, and in a case where $FT_2$ is lower than 930° C., the value of the texture forming parameter ω is meaningless. That is, $FT_2$ is 930° C. or higher and w is 110 or less.

(Finish Rolling Start Temperature is 1000° C. to 1150° C.)

When the finish rolling start temperature is lower than 1000° C., the recrystallization of the structure processed by rolling in the previous stage excluding the last two stages does not occur sufficiently, the texture of the sheet surface region is developed, and thus the texture of the surface region cannot be controlled to be within the above range. Therefore, the finish rolling start temperature is set to 1000° C. or higher. The finish rolling start temperature is preferably 1050° C. or higher. On the other hand, when the finish rolling start temperature is higher than 1150° C., the austenite grains become excessively coarse and the toughness is deteriorated. Thus, the finish rolling start temperature is set to 1150° C. or lower.

(Finish Rolling is Performed Under Condition That ω Calculated by Equation 1 is 110 or Less by Controlling Each Condition at Last Two Stages of Rolling in Multi-Stage Finish Rolling)

In the manufacturing of the hot-rolled steel sheet according to the embodiment, the hot rolling conditions in the last two stages in the multi-stage finish rolling are important.

The rolling reductions $F_1$ and $F_2$ at the time of the last two stages of rolling used to calculate ω defined by Equation 1 are numerical values expressing a difference in sheet thickness before and after rolling at each stage divided by the sheet thickness before rolling as a percentage. The diameters $D_1$ and $D_2$ of the rolling rolls are measured at room temperature, and it is not necessary to consider the flatness during hot rolling. In addition, the sheet thicknesses $t_1$ and $t_2$ on the rolling inlet side, and the sheet thickness $t_f$ after finish rolling may be measured on the spot using radiation or the like or may be obtained by calculation from a rolling force in consideration of deformation resistance and the like. The sheet thickness $t_f$ after finish rolling may be the final sheet thickness of the steel sheet after the completion of hot rolling. Regarding the rolling start temperatures $FT_1$ and $FT_2$, the values measured by a thermometer such as a radiation-type thermometer between the finish rolling stands may be used.

The texture forming parameter ω is an index in consideration of the rolling strain introduced into the entire steel sheet in the last two stages of finish rolling, the shear strain introduced into the sheet surface region, and the recrystallization rate after rolling, and means the ease of forming a texture. When the last two stages of finish rolling are performed under the condition that the texture forming parameter ω is more than 110, the average of pole densities in the crystal orientation group consisting of {211}<111> to {111}<112> and the pole density in the crystal orientation of {110}<001> is developed in the surface region and the texture of the surface region cannot be controlled to be within the above range. Therefore, in the finish rolling step, the texture forming parameter ω is controlled to 110 or less.

In addition, in a case where the texture forming parameter ω is set to 98 or less, the amount of shear strain introduced into the sheet surface region is reduced and the recrystallization behavior in the internal region which is from ⅛ to ⅜ of the sheet thickness is promoted. Thus, in addition to the texture of the sheet surface region, the sum of the pole density in the crystal orientation of {332}<113> and the pole density in the crystal orientation of {110}<001> is 7.0 or less in the internal region, and the inner bending crack becomes difficult to occur. Therefore, it is preferable that the texture forming parameter ω is set to 98 or less in the finish rolling step.

(Rolling Temperature FT1 in One Stage Before Final Stage is 960° C. to 1020° C.)

When the rolling temperature $FT_1$ in one stage before the final stage is lower than 960° C., the recrystallization of the structure worked by rolling does not sufficiently occur and the texture of the surface region cannot be controlled to be within the above range. Therefore, the rolling temperature $FT_1$ is set to 960° C. or higher. On the other hand, when the rolling temperature $FT_1$ is higher than 1020° C., the formation state and recrystallization behavior of the worked structure are changed due to coarsening of austenite grains or the like. Thus, the texture of the surface region cannot be controlled to be within the above range. Therefore, the rolling temperature $FT_1$ is set to 1020° C. or lower.

(Rolling Reduction $F_1$ in One Stage Before Final Stage is More Than 11% and 23% or Less)

When the rolling reduction $F_1$ in one stage before the final stage is 11% or less, the amount of strain introduced into the steel sheet by rolling is insufficient, recrystallization does not occur sufficiently, and thus, the texture of the surface region cannot be controlled to be within the above range. Therefore, the rolling reduction $F_1$ is set to more than 11%. On the other hand, when the rolling reduction $F_1$ is more than 23%, the lattice defect in the crystals is excessive and the recrystallization behavior is changed. Thus, the texture of the surface region cannot be controlled to be within the above range. Therefore, the rolling reduction $F_1$ is set to 23% or less.

The rolling reduction $F_1$ is calculated as follows.

$$F_1=(t_1-t_2)/t_1\times 100$$

(Rolling temperature $FT_2$ in Final Stage is 930° C. to 995° C.)

When the rolling temperature $FT_2$ in the final stage is lower than 930° C., the recrystallization rate of austenite is significantly reduced, and the sum of the average of pole densities in the crystal orientation group consisting of {211}<111> to {111}<112> and the pole density in the crystal orientation of {110}<001> cannot be controlled to be 6.0 or less in the surface region. Therefore, the rolling temperature $FT_2$ is set to 930° C. or higher. On the other hand, when the rolling temperature $FT_2$ is higher than 995° C., the formation state of the worked structure and the recrystallization behavior are changed, and thus the texture of the surface region cannot be controlled to be within the above range. Therefore, the rolling temperature $FT_2$ is set to 995° C. or lower.

(Rolling Reduction $F_2$ of Final Stage is More Than 11% and 22% or Less)

When the rolling reduction $F_2$ of the final stage is 11% or less, the amount of strain introduced into the steel sheet by rolling is insufficient, recrystallization does not occur sufficiently, and thus the texture of the surface region cannot be controlled to be within the above range. Therefore, the rolling reduction $F_2$ is set to more than 11%. On the other hand, when the rolling reduction $F_2$ is more than 22%, the lattice defect in the crystals is excessive, the recrystallization behavior is changed, and thus the texture of the surface region cannot be controlled to be within the above range. Therefore, the rolling reduction $F_2$ is set to 22% or less.

The rolling reduction $F_2$ is calculated as follows.

$$F_2=(t_2-t_f)/t_2\times 100$$

(Total Rolling Reduction Ft in Last Three Stages is 35% or More)

It is preferable that the total rolling reduction Ft in the last three stages is large in order to promote the recrystallization of austenite. When the total rolling reduction Ft in the last three stages is less than 35%, the recrystallization rate of austenite is significantly reduced, and the sum of the average of pole densities in the crystal orientation group consisting of {211}<111> to {111}<112> and the pole density in the crystal orientation of {110}<001> cannot be controlled to be 6.0 or less in the surface region. On the other hand, the upper limit of the total rolling reduction Ft is not particularly limited. In order to preferably control the recrystallization behavior, the total rolling reduction Ft is preferably 43% or less.

The total rolling reduction Ft in the last three stages is calculated as follows.

$$Ft=(t_0-t_f)/t_0\times 100$$

Herein, $t_0$ is the sheet thickness at the start of rolling in two stages before the final stage (unit: mm).

In the finish rolling step, each of the above conditions is controlled simultaneously and inseparably. Each of the above-mentioned conditions does not have to satisfy only one of the above-mentioned conditions, and when all of the above-mentioned conditions are satisfied at the same time, the texture of the surface region can be controlled to be within the above-mentioned range.

The hot-rolled steel sheet after finish rolling is cooled and coiled. In the hot-rolled steel sheet according to the embodiment, excellent bending workability is achieved by controlling the texture rather than the base structure (constituent phase of the steel structure). Therefore, the manufacturing conditions are not particularly limited in the cooling step and the coiling step. Therefore, the cooling step and the coiling step after the multi-stage finish rolling may be performed by an ordinary method.

The constituent phase of the steel sheet during finish rolling is mainly austenite, and the texture of austenite is controlled by the finish rolling described above. The high temperature stable phase such as austenite undergoes a phase transformation to a low temperature stable phase such as bainite at the time of cooling and coiling after finish rolling. Due to this phase transformation, the crystal orientation may be changed and the texture of the steel sheet after cooling may be changed. However, with respect to the hot-rolled steel sheet according to the embodiment, the above-mentioned crystal orientation controlled in the surface region is not significantly affected by cooling and coiling after finish rolling. That is, when the texture is controlled to austenite at the time of finish rolling, even in a case where the phase is transformed into a low temperature stable phase such as bainite at the time of the following cooling and coiling, this low temperature stable phase satisfies the definition of the above-mentioned texture in the surface region. The same applies to the texture of the internal region of sheet thickness.

In addition, the hot-rolled steel sheet according to the embodiment may be pickled as required after cooling. Even when this pickling treatment is performed, the texture of the surface region does not change. For example, the pickling treatment may be carried out with hydrochloric acid having a concentration of 3 to 10% at a temperature of 85° C. to 98° C. for 20 seconds to 100 seconds.

In addition, the hot-rolled steel sheet according to the embodiment may be subjected to skin pass rolling as required after cooling. In this skin pass rolling, the rolling reduction may be set so that the texture of the surface region is not changed. The skin pass rolling has the effect of preventing stretcher strain generated at the time of work forming and correcting shape.

Example 1

Hereinafter, the effects of an aspect of the present invention are described in detail with reference to the following examples. However, the condition in the examples is an example condition employed to confirm the operability and the effects of the present invention, so that the present invention is not limited to the example condition. The present invention can employ various types of conditions as long as the conditions do not depart from the scope of the present invention and can achieve the object of the present invention.

A steel having a predetermined chemical composition was cast, and after casting, the slab was cooled as it is or once cooled to room temperature, then reheated, and heated to a temperature range of 1200° C. to 1300° C. Then, the slab was subjected to rough rolling at a temperature of 1100° C. or higher until the desired sheet thickness of the rough-rolled sheet was obtained, and thus a rough-rolled sheet was prepared. The rough-rolled sheet was subjected to multi-stage finish rolling including seven stages in total. The steel sheet after finish rolling was cooled and coiled to prepare a hot-rolled steel sheet.

Tables 1 and 2 show the chemical composition of the hot-rolled steel sheet. Regarding the chemical composition, the values marked with "<" in the table indicate that the values are equal to or less than the detection limit of the measuring device and these elements are not intentionally added to the steel.

In addition, in the finish rolling step, finish rolling was started from the temperatures shown in Tables 3 to 6, and rolling was performed to the sheet thickness $t_0$ at the start time of rolling in two stages before the final stage shown in Tables 3 to 6 by a total of four stages of rolling from the start of rolling excluding the last three stages of rolling. Then, rolling in the last three stages was performed by the total rolling reduction Ft shown in Tables 7 to 10. Moreover, the last two stages of rolling were performed under the conditions shown in Tables 3 to 10. After the completion of finish rolling, cooling and coiling were performed with each cooling pattern shown below to obtain a hot-rolled steel sheet having a sheet thickness $t_f$ shown in Tables 3 to 6. The final sheet thickness of the steel sheet after the completion of hot rolling was defined as the sheet thickness $t_f$ after finish rolling.

(Cooling Pattern B: Bainite Pattern)

In this pattern, after the finish rolling was completed, the steel sheet was cooled to a coiling temperature of 450° C. to 550° C. at an average cooling rate of 20° C./sec or higher, and then coiled into a coil shape.

(Cooling Pattern F+B: Ferrite-Bainite Pattern)

In this pattern, after the finish rolling is completed, the steel sheet was cooled to a cooling stop temperature range of 600° C. to 750° C. at an average cooling rate of 20° C./sec or higher, the cooling is stopped within the cooling stop temperature range, and the steel sheet was retained for 2 to 4 seconds. Then, the steel sheet was further coiled into a coil shape at an average cooling rate of 20° C./sec or higher and a coiling temperature of 550° C. or lower. The cooling stop temperature and the retention time were set with reference to the Ar3 temperature below.

$$Ar3(^\circ C.)=870-390C+24Si-70Mn-50Ni-5Cr-20Cu+80Mo$$

(Cooling Pattern Ms: Martensite Pattern)

In this pattern, after the finish rolling was completed, the steel sheet was cooled to a coiling temperature of 100° C. or lower at an average cooling rate of 20° C./sec or higher, and then coiled into a coil shape.

In addition, in test materials Nos. 1 to 128, rough rolling was performed with a total rolling reduction of 40% or more in a range of 1200° C. to 1100° C., and finish rolling was performed such that a total rolling reduction of the five stages other than the last two stages in multi-stage finish rolling was 50% or more. However, each total rolling reduction is a numerical value expressed as a percentage calculated based on the sheet thickness at the time of the start of rough rolling and at the time of the start of finish rolling and the sheet thickness at the time of the completion of rough rolling and at the time of the completion of the fifth finish rolling stage.

Tables 1 and 2 show the chemical composition, Tables 3 to 10 show each manufacturing condition, and Tables 11 to 14 show each manufacturing result of the prepared hot-rolled steel sheets. In the column of "Cooling and coiling pattern" in Tables 7 to 10, "B" indicates a bainite pattern, "F+B" indicates a ferrite-bainite pattern, and "Ms" indicates a martensite pattern. Further, in the column of "Texture" in Tables 11 to 14, "Sum A of pole densities" indicates a sum of an average of pole densities in a crystal orientation group consisting of {211}<111> to {111}<112> and a pole density in a crystal orientation of {110}<001>, and "Sum B of pole densities" indicates a sum of a pole density in a crystal orientation of {332}<113> and a pole density in a crystal orientation of {110}<001>. In addition, each symbol used in the table corresponds to the symbol described above.

Regarding the tensile strength, a tensile test was performed according to JIS Z 2241 (2011) using a JIS No. 5 test piece collected from a ¼ position in the width direction of the hot-rolled steel sheet so that the direction perpendicular to the rolling direction (C direction) is the longitudinal direction, and the maximum tensile strength TS and butt elongation (total elongation) EL were obtained.

In a bending test, a test piece cut out in a strip shape of 100 mm×30 mm from a ½ position in the width direction of the hot-rolled steel sheet was used. The bending test for both bending (L-axis bending) where the bending ridge was parallel to the rolling direction (L direction) and bending (C-axis bending) where the bending ridge was parallel to the direction perpendicular to the rolling direction (C direction) was performed according to JIS Z 2248 (2014) (V block 90° bending test) to obtain the minimum bend radius which does not cause cracks. However, the presence or absence of cracks was confirmed by mirror-polishing a cross section obtained by cutting the test piece after the V block 90° bending test on the surface parallel to the bending direction and perpendicular to the sheet surface and then observing cracks on the inner face of the bending of the test piece with an optical microscope. In a case where the length of the observed cracks was longer than 30 μm, it was determined that there were cracks. In addition, the critical bending RA which was the value obtained by dividing the average of the minimum inner bend radius of L-axis bending and the minimum inner bend radius of C-axis bending by the sheet thickness used an index for bendability.

The numbers underlined in Tables 1 to 14 indicate that the numbers are out of the scope of the present invention.

In Tables 1 to 14, the test material Nos. described as "Inventive Example" are steel sheets satisfying all of the conditions of the present invention.

In Inventive Examples, the steel composition is satisfied, the sum of the average of pole densities in the crystal orientation group consisting of {211}<111> to {111}<112> and the pole density in the crystal orientation of {110}<001> is 0.5 to 6.0 in the surface region, and the tensile strength is 780 MPa or more. Therefore, the critical bending R/t is 2.2 or less, and a hot-rolled steel sheet having excellent bendability such that the inner bending crack is suppressed can be obtained.

On the other hand, in Tables 1 to 14, the test material Nos. described as "Comparative Example" are steel sheets not satisfying at least one of the steel composition, the texture of the surface region, or the tensile strength.

In test material No. 5, since the Mn content was out of the control range, the tensile strength was not sufficient.

In test material No. 8, since the Mn content was out of the control range, the suppression of the inner bending crack was not sufficient.

In test material No. 9, since the C content was out of the control range, the tensile strength was not sufficient.

In test material No. 15, since the Ti content and the texture forming parameter ω were out of the control range, the texture was not satisfied and the suppression of the inner bending crack was not sufficient.

In test material No. 19, since the Nb content and the texture forming parameter ω were out of the control range, the texture was not satisfied and the suppression of the inner bending crack was not sufficient.

In test material No. 30, since the finish rolling conditions $FT_1$ and $FT_2$ were out of the control range, the texture was not satisfied and the suppression of the inner bending crack was not sufficient.

In test material No. 32, since the finish rolling conditions $FT_1$ and $FT_2$ were out of the control range, the texture was not satisfied and the suppression of the inner bending crack was not sufficient.

In test material No. 34, since the texture forming parameter ω was out of the control range, the texture was not satisfied and the suppression of the inner bending crack was not sufficient.

In test material No. 48, since the Ti content and the texture forming parameter ω were out of the control range, the texture was not satisfied and the suppression of the inner bending crack was not sufficient.

In test material No. 51, since the Nb content and the texture forming parameter ω were out of the control range, the texture was not satisfied and the suppression of the inner bending crack was not sufficient.

In test material No. 55, since the finish rolling condition $FT_1$ and the texture forming parameter ω were out of the control range, the texture was not satisfied and the suppression of the inner bending crack was not sufficient.

In test material No. 58, since the finish rolling condition $FT_1$ and the texture forming parameter ω were out of the control range, the texture was not satisfied and the suppression of the inner bending crack was not sufficient.

In test material No. 63, since the finish rolling condition $F_1$ and the texture forming parameter ω were out of the control range, the texture was not satisfied and the suppression of the inner bending crack was not sufficient.

In test material No. 66, since the texture forming parameter ω was out of the control range, the texture was not satisfied and the suppression of the inner bending crack was not sufficient.

In test material No. 71, since the texture forming parameter ω was out of the control range, the texture was not satisfied and the suppression of the inner bending crack was not sufficient.

In test material No. 74, since the finish rolling condition $F_1$ and the texture forming parameter ω were out of the control range, the texture was not satisfied and the suppression of the inner bending crack was not sufficient.

In test material No. 79, since the texture forming parameter ω was out of the control range, the texture was not satisfied and the suppression of the inner bending crack was not sufficient.

In test material No. 82, since the texture forming parameter ω was out of the control range, the texture was not satisfied and the suppression of the inner bending crack was not sufficient.

In test material No. 87, since the texture forming parameter ω was out of the control range, the texture was not satisfied and the suppression of the inner bending crack was not sufficient.

In test material No. 95, since the finish rolling condition $F_1$ and the texture forming parameter ω were out of the control range, the texture was not satisfied and the suppression of the inner bending crack was not sufficient.

In test material No. 98, since the finish rolling condition $F_2$ and the texture forming parameter ω were out of the control range, the texture was not satisfied and the suppression of the inner bending crack was not sufficient.

In test material No. 103, since the finish rolling start temperature and the finish rolling condition $F_1$ were out of the control range, the texture was not satisfied and the suppression of the inner bending crack was not sufficient.

In test material No. 111, since the finish rolling condition Ft was out of the control range, the texture was not satisfied and the suppression of the inner bending crack was not sufficient.

In test material No. 113, since the thickness of the rough-rolled sheet was out of the control range, the texture was not satisfied and the suppression of the inner bending crack was not sufficient.

In test material No. 116, since the thickness of the rough-rolled sheet was out of the control range, the texture was not satisfied and the suppression of the inner bending crack was not sufficient.

In test material No. 117, since the finish rolling condition $FT_1$ was out of the control range, the texture was not satisfied and the suppression of the inner bending crack was not sufficient.

In test material No. 118, since the finish rolling condition $FT_2$ was out of the control range, the texture was not satisfied and the suppression of the inner bending crack was not sufficient.

In test material No. 119, since the finish rolling condition $FT_2$ was out of the control range, the texture was not satisfied and the suppression of the inner bending crack was not sufficient.

In test material No. 120, since the finish rolling condition $FT_1$ was out of the control range, the texture was not satisfied and the suppression of the inner bending crack was not sufficient.

In test material No. 121, since the finish rolling condition $F_2$ and the texture forming parameter ω were out of the control range, the texture was not satisfied and the suppression of the inner bending crack was not sufficient.

In test material No. 122, since the finish rolling condition $FT_2$ was out of the control range, the texture was not satisfied and the suppression of the inner bending crack was not sufficient.

In test material No. 123, since the finish rolling start temperature was out of the control range, the texture was not satisfied and the suppression of the inner bending crack was not sufficient.

In test material No. 124, since the Si content, the thickness of the rough-rolled sheet, the finish rolling start temperature, and the finish rolling condition $F_1$ were out of the control range, the texture was not satisfied and the suppression of the inner bending crack was not sufficient.

In test material No. 125, since the finish rolling conditions $F_1$ and $F_2$ were out of the control range, the texture was not satisfied and the suppression of the inner bending crack was not sufficient.

In test material No. 126, since the finish rolling conditions $FT_1$ and $FT_2$ were out of the control range, the texture was not satisfied and the suppression of the inner bending crack was not sufficient.

In test material No. 127, since the thickness of the rough-rolled sheet, the finish rolling start temperature, and the finish rolling condition $F_1$, and $F_2$ were out of the control range, the texture was not satisfied and the suppression of the inner bending crack was not sufficient.

In Examples in which the rolling temperature $FT_2$ in the final stage was lower than 930° C., the value of the texture forming parameter ω is meaningless, and thus ω and the like are left blank in the table.

TABLE 1

| STEEL | CHEMICAL COMPOSITION (UNIT: mass %, BALANCE CONSISTING OF Fe AND IMPURITIES) | | | | | | | | | |
|---|---|---|---|---|---|---|---|---|---|---|
| TYPE | C | Si | Mn | sol. Al | Ti | Nb | P | S | N | OTHER |
| A | 0.07 | 0.80 | 2.20 | 0.050 | 0.120 | 0.018 | 0.010 | 0.001 | 0.003 | Ca: 0.002 |
| B | 0.09 | 0.70 | 1.90 | 0.100 | 0.130 | 0.020 | 0.010 | 0.001 | 0.002 | |
| C | 0.07 | 0.08 | 2.10 | 0.100 | 0.100 | 0.030 | 0.008 | 0.001 | 0.003 | |
| D | 0.10 | 2.10 | 2.60 | 0.025 | 0.110 | 0.020 | 0.010 | 0.002 | 0.002 | B: 0001 |
| E | 0.06 | 1.00 | 0.80 | 0.029 | 0.100 | 0.010 | 0.010 | 0.001 | 0.003 | |
| F | 0.08 | 1.23 | 1.10 | 0.020 | 0.140 | 0.010 | 0.012 | 0.003 | 0.003 | |
| G | 0.08 | 1.40 | 3.30 | 0.020 | 0.080 | 0.007 | 0.010 | 0.001 | 0.002 | B: 0.002 |
| H | 0.06 | 1.30 | 4.50 | 0.030 | 0.130 | 0.010 | 0.012 | 0.001 | 0.003 | |
| I | 0.01 | 0.90 | 1.10 | 0.028 | 0.015 | 0.020 | 0.010 | 0.001 | 0.003 | |
| J | 0.05 | 1.50 | 1.24 | 0.040 | 0.090 | 0.020 | 0.010 | 0.001 | 0.002 | |
| K | 0.21 | 1.20 | 2.00 | 0.030 | 0.030 | 0.010 | 0.010 | 0.002 | 0.003 | |
| L | 0.07 | 1.30 | 2.50 | 0.025 | <0.001 | 0.010 | 0.011 | 0.001 | 0.002 | |
| M | 0.06 | 1.60 | 2.30 | 0.041 | 0.050 | 0.030 | 0.009 | 0.002 | 0.002 | |
| N | 0.09 | 1.20 | 1.80 | 0.041 | 0.170 | 0.005 | 0.009 | 0.002 | 0.002 | |
| O | 0.07 | 0.80 | 1.45 | 0.010 | 0.300 | 0.010 | 0.012 | 0.002 | 0.003 | |
| P | 0.06 | 1.00 | 1.50 | 0.033 | 0.090 | <0.001 | 0.010 | 0.001 | 0.003 | |
| Q | 0.10 | 1.30 | 1.80 | 0.031 | 0.080 | 0.008 | 0.010 | 0.003 | 0.003 | |
| R | 0.11 | 1.10 | 1.21 | 0.029 | 0.100 | 0.070 | 0.011 | 0.002 | 0.003 | |
| S | 0.05 | 1.10 | 1.40 | 0.025 | 0.030 | 0.250 | 0.010 | 0.001 | 0.002 | |
| U | 0.06 | 0.70 | 1.80 | 0.030 | 0.100 | 0.007 | 0.011 | 0.001 | 0.003 | V: 0.01 |
| V | 0.08 | 1.89 | 2.21 | 0.025 | 0.090 | 0.010 | 0.010 | 0.001 | 0.003 | Cr: 0.4 |
| W | 0.12 | 1.30 | 1.80 | 0.020 | 0.090 | 0.008 | 0.012 | 0.001 | 0.003 | Mo: 0.01 |
| X | 0.06 | 1.10 | 1.60 | 0.020 | 0.110 | 0.012 | 0.010 | 0.001 | 0.002 | Cu: 0.01 |
| Y | 0.06 | 1.02 | 2.01 | 0.030 | 0.100 | 0.020 | 0.010 | 0.001 | 0.003 | Co: 0.1 |
| Z | 0.06 | 0.90 | 1.88 | 0.029 | 0.110 | 0.007 | 0.010 | 0.001 | 0.003 | W: 0.01 |

TABLE 2

| STEEL | CHEMICAL COMPOSITION (UNIT: mass %, BALANCE CONSISTING OF Fe AND IMPURITIES) | | | | | | | | | |
|---|---|---|---|---|---|---|---|---|---|---|
| TYPE | C | Si | Mn | sol. Al | Ti | Nb | P | S | N | OTHER |
| AA | 0.07 | 1.80 | 1.10 | 0.020 | 0.110 | 0.010 | 0.012 | 0.003 | 0.003 | Ni: 0.8 |
| AB | 0.11 | 1.20 | 2.70 | 0.021 | 0.100 | 0.030 | 0.013 | 0.001 | 0.002 | Mg: 0.002 |
| AC | 0.08 | 0.87 | 1.30 | 0.030 | 0.080 | 0.021 | 0.011 | 0.002 | 0.003 | REM: 0.001 |
| AD | 0.09 | 1.43 | 2.10 | 0.130 | 0.120 | 0.031 | 0.014 | 0.001 | 0.002 | Zr: 0.002 |
| AE | 0.05 | 0.90 | 1.60 | 0.030 | 0.030 | 0.040 | 0.010 | 0.003 | 0.003 | B: 0.002 |
| AF | 0.06 | 1.10 | 1.20 | 0.027 | 0.090 | 0.015 | 0.010 | 0.003 | 0.003 | |
| AG | 0.13 | 0.12 | 2.80 | 0.030 | 0.190 | 0.100 | 0.015 | 0.005 | 0.003 | B: 0.0012 |
| AH | 0.06 | 0.049 | 2.45 | 0.045 | 0.021 | <0.001 | 0.013 | 0.003 | 0.004 | B: 0.001 |
| AI | 0.04 | 1.20 | 1.00 | 0.120 | 0.110 | <0.001 | 0.015 | 0.003 | 0.004 | |
| AJ | 0.15 | 0.80 | 2.00 | 0.400 | 0.070 | 0.035 | 0.014 | 0.003 | 0.004 | Cr: 0.3 |
| AK | 0.19 | 1.28 | 2.46 | 0.300 | <0.001 | <0.001 | 0.017 | 0.001 | 0.004 | |
| AL | 0.08 | 1.87 | 2.22 | 0.024 | 0.090 | 0.020 | 0.010 | 0.001 | 0.003 | Cr: 0.2<br>Mo: 0.1<br>B0.002 |

TABLE 3

| TEST MATERIAL No. | STEEL TYPE | SHEET THICKNESS tf (mm) | SHEET THICKNESS OF ROUGH-ROLLED SHEET (mm) | FINISH ROLLING START TEMPERATURE (° C.) | FINISH ROLLING CONDITIONS | | | | | | | |
|---|---|---|---|---|---|---|---|---|---|---|---|---|
| | | | | | Ti (mass %) | Nb (mass %) | Ti + 1.3Nb (mass %) | FT1 (° C.) | FT2 (° C.) | t0 (mm) | t1 (mm) | D1 (mm) |
| 1 | A | 2.9 | 40 | 1070 | 0.120 | 0.018 | 0.143 | 985 | 971 | 4.9 | 4.11 | 720 |
| 2 | B | 2.9 | 40 | 1072 | 0.130 | 0.020 | 0.156 | 988 | 967 | 4.8 | 4.03 | 720 |
| 3 | C | 2.9 | 40 | 1050 | 0.100 | 0.030 | 0.139 | 989 | 966 | 4.8 | 4.01 | 720 |
| 4 | D | 2.9 | 40 | 1045 | 0.110 | 0.020 | 0.136 | 994 | 964 | 5.0 | 4.27 | 720 |
| 5 | E | 2.9 | 40 | 1042 | 0.100 | 0.010 | 0.113 | 985 | 974 | 4.8 | 4.37 | 720 |
| 6 | F | 2.9 | 40 | 1050 | 0.140 | 0.010 | 0.153 | 995 | 968 | 4.9 | 4.25 | 720 |
| 7 | G | 2.9 | 40 | 1071 | 0.080 | 0.007 | 0.089 | 991 | 966 | 4.7 | 4.34 | 720 |

TABLE 3-continued

| TEST MATERIAL No. | STEEL TYPE | SHEET THICKNESS tf (mm) | SHEET THICKNESS OF ROUGH-ROLLED SHEET (mm) | FINISH ROLLING START TEMPERATURE (° C.) | FINISH ROLLING CONDITIONS Ti (mass %) | Nb (mass %) | Ti + 1.3Nb (mass %) | FT1 (° C.) | FT2 (° C.) | t0 (mm) | t1 (mm) | D1 (mm) |
|---|---|---|---|---|---|---|---|---|---|---|---|---|
| 8 | H | 2.9 | 40 | 1043 | 0.130 | 0.010 | 0.143 | 989 | 970 | 4.8 | 4.30 | 720 |
| 9 | I | 2.9 | 40 | 1070 | 0.015 | 0.020 | 0.041 | 986 | 966 | 4.7 | 4.00 | 720 |
| 10 | J | 2.9 | 40 | 1058 | 0.090 | 0.020 | 0.116 | 988 | 965 | 5.0 | 3.98 | 720 |
| 11 | K | 2.9 | 40 | 1062 | 0.030 | 0.010 | 0.043 | 996 | 969 | 5.0 | 4.24 | 720 |
| 12 | L | 2.9 | 40 | 1039 | <0.001 | 0.010 | 0.013 | 991 | 969 | 4.8 | 4.20 | 720 |
| 13 | M | 2.9 | 40 | 1063 | 0.050 | 0.030 | 0.089 | 986 | 971 | 4.8 | 4.38 | 720 |
| 14 | N | 2.9 | 40 | 1062 | 0.170 | 0.005 | 0.177 | 988 | 962 | 4.7 | 3.93 | 720 |
| 15 | O | 2.9 | 40 | 1063 | 0.300 | 0.010 | 0.313 | 989 | 972 | 4.9 | 4.14 | 720 |
| 16 | P | 2.9 | 40 | 1052 | 0.090 | <0.001 | 0.090 | 989 | 970 | 4.7 | 4.07 | 720 |
| 17 | Q | 2.9 | 40 | 1066 | 0.080 | 0.008 | 0.090 | 986 | 964 | 4.7 | 4.34 | 720 |
| 18 | R | 2.9 | 40 | 1053 | 0.100 | 0.070 | 0.191 | 996 | 965 | 4.9 | 4.25 | 720 |
| 19 | S | 2.9 | 40 | 1038 | 0.030 | 0.250 | 0.355 | 987 | 966 | 4.7 | 4.04 | 720 |
| 20 | U | 2.9 | 40 | 1049 | 0.100 | 0.007 | 0.109 | 997 | 966 | 4.8 | 4.08 | 720 |
| 21 | V | 2.9 | 40 | 1053 | 0.090 | 0.010 | 0.103 | 987 | 967 | 4.8 | 4.34 | 720 |
| 22 | W | 2.9 | 40 | 1060 | 0.090 | 0.008 | 0.100 | 986 | 969 | 4.8 | 4.23 | 720 |
| 23 | X | 2.9 | 40 | 1040 | 0.110 | 0.012 | 0.126 | 990 | 972 | 4.7 | 4.26 | 720 |
| 24 | Y | 2.9 | 40 | 1084 | 0.100 | 0.020 | 0.126 | 992 | 967 | 4.8 | 3.95 | 720 |
| 25 | Z | 2.9 | 40 | 1063 | 0.110 | 0.007 | 0.119 | 992 | 967 | 4.8 | 4.05 | 720 |
| 26 | AA | 2.9 | 40 | 1038 | 0.110 | 0.010 | 0.123 | 991 | 963 | 4.8 | 4.29 | 720 |
| 27 | AB | 2.9 | 40 | 1071 | 0.100 | 0.030 | 0.139 | 985 | 968 | 4.8 | 4.38 | 720 |
| 28 | AC | 2.9 | 40 | 1051 | 0.080 | 0.021 | 0.107 | 995 | 973 | 5.0 | 4.22 | 720 |
| 29 | AD | 2.9 | 40 | 1045 | 0.120 | 0.031 | 0.160 | 996 | 967 | 4.8 | 4.20 | 720 |
| 30 | AE | 2.9 | 40 | 1076 | 0.030 | 0.040 | 0.082 | 911 | 880 | 4.7 | 4.09 | 720 |
| 31 | AE | 2.9 | 40 | 1067 | 0.030 | 0.040 | 0.082 | 984 | 964 | 4.9 | 4.19 | 720 |
| 32 | AF | 2.9 | 40 | 1056 | 0.090 | 0.015 | 0.110 | 936 | 910 | 4.8 | 4.02 | 720 |
| 33 | AF | 2.9 | 40 | 1038 | 0.090 | 0.015 | 0.110 | 992 | 973 | 4.9 | 4.31 | 720 |
| 34 | AG | 3.6 | 40 | 1056 | 0.190 | 0.100 | 0.320 | 966 | 935 | 5.9 | 5.16 | 720 |
| 35 | AG | 3.6 | 40 | 1059 | 0.190 | 0.100 | 0.320 | 1016 | 994 | 5.8 | 5.13 | 720 |
| 36 | A | 2.0 | 40 | 1054 | 0.120 | 0.018 | 0.143 | 989 | 972 | 3.3 | 2.92 | 720 |

TABLE 4

| TEST MATERIAL No. | STEEL TYPE | SHEET THICKNESS tf (mm) | SHEET THICKNESS OF ROUGH-ROLLED SHEET (mm) | FINISH ROLLING START TEMPERATURE (° C.) | FINISH ROLLING CONDITIONS Ti (mass %) | Nb (mass %) | Ti + 1.3Nb (mass %) | FT1 (° C.) | FT2 (° C.) | t0 (mm) | t1 (mm) | D1 (mm) |
|---|---|---|---|---|---|---|---|---|---|---|---|---|
| 37 | A | 2.3 | 40 | 1039 | 0.120 | 0.018 | 0.143 | 983 | 971 | 3.7 | 3.12 | 720 |
| 38 | A | 2.9 | 40 | 1064 | 0.120 | 0.018 | 0.143 | 985 | 965 | 4.9 | 4.44 | 720 |
| 39 | A | 3.6 | 40 | 1047 | 0.120 | 0.018 | 0.143 | 993 | 969 | 6.2 | 5.21 | 720 |
| 40 | A | 4.0 | 40 | 1034 | 0.120 | 0.018 | 0.143 | 986 | 971 | 6.5 | 5.92 | 720 |
| 41 | A | 5.0 | 40 | 1086 | 0.120 | 0.018 | 0.143 | 994 | 968 | 8.6 | 7.35 | 720 |
| 42 | A | 2.9 | 40 | 1078 | 0.120 | 0.018 | 0.143 | 965 | 985 | 5.0 | 4.28 | 760 |
| 43 | A | 2.9 | 40 | 1062 | 0.120 | 0.018 | 0.143 | 995 | 962 | 4.6 | 4.55 | 760 |
| 44 | A | 3.3 | 40 | 1067 | 0.120 | 0.018 | 0.143 | 969 | 965 | 5.7 | 5.02 | 760 |
| 45 | A | 3.3 | 40 | 1072 | 0.120 | 0.018 | 0.143 | 970 | 955 | 5.5 | 4.70 | 760 |
| 46 | A | 2.9 | 40 | 1060 | 0.120 | 0.018 | 0.143 | 998 | 990 | 5.0 | 4.09 | 760 |
| 47 | A | 2.9 | 40 | 1060 | 0.120 | 0.018 | 0.143 | 962 | 952 | 4.7 | 4.37 | 760 |
| 48 | O | 2.3 | 40 | 1057 | 0.300 | 0.010 | 0.313 | 993 | 967 | 3.9 | 3.21 | 732 |
| 49 | M | 2.3 | 40 | 1065 | 0.050 | 0.030 | 0.089 | 986 | 964 | 3.9 | 3.31 | 732 |
| 50 | N | 2.3 | 40 | 1066 | 0.170 | 0.005 | 0.177 | 994 | 972 | 3.9 | 3.23 | 732 |
| 51 | S | 2.3 | 40 | 1076 | 0.030 | 0.250 | 0.355 | 985 | 964 | 3.8 | 3.29 | 732 |
| 52 | R | 2.3 | 40 | 1063 | 0.100 | 0.070 | 0.191 | 995 | 964 | 3.8 | 3.26 | 732 |
| 53 | Q | 2.3 | 40 | 1081 | 0.080 | 0.008 | 0.090 | 993 | 969 | 4.0 | 3.46 | 732 |
| 54 | T | 2.3 | 40 | 1072 | <0.001 | <0.001 | 0 | 993 | 965 | 3.8 | 3.11 | 732 |
| 55 | B | 2.3 | 40 | 1067 | 0.130 | 0.020 | 0.156 | 952 | 945 | 3.7 | 3.20 | 732 |
| 56 | B | 2.3 | 40 | 1066 | 0.130 | 0.020 | 0.156 | 963 | 961 | 3.7 | 3.50 | 732 |
| 57 | B | 2.3 | 40 | 1069 | 0.130 | 0.020 | 0.156 | 968 | 962 | 3.8 | 3.41 | 732 |
| 58 | B | 4.0 | 40 | 1071 | 0.130 | 0.020 | 0.156 | 946 | 943 | 6.8 | 6.06 | 720 |
| 59 | B | 4.0 | 40 | 1050 | 0.130 | 0.020 | 0.156 | 965 | 955 | 6.6 | 6.19 | 720 |
| 60 | B | 4.0 | 40 | 1041 | 0.130 | 0.020 | 0.156 | 970 | 965 | 6.8 | 5.94 | 720 |
| 61 | T | 4.0 | 40 | 1069 | <0.001 | <0.001 | 0 | 960 | 936 | 6.6 | 5.85 | 720 |
| 62 | T | 4.0 | 40 | 1047 | <0.001 | <0.001 | 0 | 972 | 952 | 6.8 | 5.95 | 720 |
| 63 | B | 2.3 | 40 | 1044 | 0.130 | 0.020 | 0.156 | 988 | 943 | 3.7 | 3.07 | 732 |
| 64 | B | 2.3 | 40 | 1040 | 0.130 | 0.020 | 0.156 | 991 | 953 | 3.9 | 3.18 | 732 |

TABLE 4-continued

| TEST MATERIAL No. | STEEL TYPE | SHEET THICKNESS tf (mm) | SHEET THICKNESS OF ROUGH-ROLLED SHEET (mm) | FINISH ROLLING START TEMPERATURE (° C.) | FINISH ROLLING CONDITIONS Ti (mass %) | Nb (mass %) | Ti + 1.3Nb (mass %) | FT1 (° C.) | FT2 (° C.) | t0 (mm) | t1 (mm) | D1 (mm) |
|---|---|---|---|---|---|---|---|---|---|---|---|---|
| 65 | B | 2.3 | 40 | 1071 | 0.130 | 0.020 | 0.156 | 986 | 963 | 4.0 | 3.09 | 732 |
| 66 | B | 4.0 | 40 | 1076 | 0.130 | 0.020 | 0.156 | 994 | 939 | 6.6 | 5.84 | 720 |
| 67 | B | 4.0 | 40 | 1057 | 0.130 | 0.020 | 0.156 | 988 | 954 | 6.8 | 6.15 | 720 |
| 68 | B | 4.0 | 40 | 1056 | 0.130 | 0.020 | 0.156 | 990 | 961 | 6.6 | 5.80 | 720 |
| 69 | T | 4.0 | 40 | 1082 | <0.001 | <0.001 | 0 | 993 | 949 | 6.7 | 6.02 | 720 |
| 70 | T | 4.0 | 40 | 1037 | <0.001 | <0.001 | 0 | 987 | 958 | 6.8 | 5.79 | 720 |
| 71 | B | 2.3 | 40 | 1033 | 0.130 | 0.020 | 0.156 | 993 | 970 | 3.7 | 3.10 | 1500 |
| 72 | B | 2.3 | 40 | 1034 | 0.130 | 0.020 | 0.156 | 987 | 969 | 3.9 | 3.10 | 800 |

TABLE 5

| TEST MATERIAL No. | STEEL TYPE | SHEET THICKNESS tf (mm) | SHEET THICKNESS OF ROUGH-ROLLED SHEET (mm) | FINISH ROLLING START TEMPERATURE (° C.) | FINISH ROLLING CONDITIONS Ti (mass %) | Nb (mass %) | Ti + 1.3Nb (mass %) | FT1 (° C.) | FT2 (° C.) | t0 (mm) | t1 (mm) | D1 (mm) |
|---|---|---|---|---|---|---|---|---|---|---|---|---|
| 73 | B | 2.3 | 40 | 1056 | 0.130 | 0.020 | 0.156 | 998 | 971 | 3.7 | 3.20 | 700 |
| 74 | B | 4.0 | 40 | 1042 | 0.130 | 0.020 | 0.156 | 978 | 956 | 6.7 | 5.54 | 1500 |
| 75 | B | 4.0 | 40 | 1067 | 0.130 | 0.020 | 0.156 | 985 | 972 | 6.8 | 5.82 | 800 |
| 76 | B | 4.0 | 40 | 1080 | 0.130 | 0.020 | 0.156 | 990 | 970 | 6.7 | 5.95 | 700 |
| 77 | T | 4.0 | 40 | 1070 | <0.001 | <0.001 | 0 | 990 | 965 | 6.4 | 5.65 | 800 |
| 78 | T | 4.0 | 40 | 1062 | <0.001 | <0.001 | 0 | 988 | 970 | 6.7 | 5.71 | 700 |
| 79 | B | 2.3 | 40 | 1055 | 0.130 | 0.020 | 0.156 | 991 | 972 | 3.7 | 3.06 | 732 |
| 80 | B | 2.3 | 40 | 1067 | 0.130 | 0.020 | 0.156 | 988 | 971 | 3.9 | 3.20 | 732 |
| 81 | B | 2.3 | 40 | 1076 | 0.130 | 0.020 | 0.156 | 987 | 973 | 3.7 | 3.17 | 732 |
| 82 | B | 4.0 | 40 | 1055 | 0.130 | 0.020 | 0.156 | 993 | 964 | 6.5 | 5.64 | 720 |
| 83 | B | 4.0 | 40 | 1054 | 0.130 | 0.020 | 0.156 | 985 | 961 | 6.5 | 5.86 | 720 |
| 84 | B | 4.0 | 40 | 1032 | 0.130 | 0.020 | 0.156 | 989 | 967 | 6.6 | 6.00 | 720 |
| 85 | T | 4.0 | 40 | 1070 | <0.001 | <0.001 | 0 | 989 | 965 | 6.8 | 5.86 | 720 |
| 86 | T | 4.0 | 40 | 1052 | <0.001 | <0.001 | 0 | 987 | 968 | 6.8 | 5.84 | 720 |
| 87 | B | 2.3 | 40 | 1061 | 0.130 | 0.020 | 0.156 | 986 | 971 | 3.9 | 3.05 | 732 |
| 88 | B | 2.3 | 40 | 1059 | 0.130 | 0.020 | 0.156 | 992 | 968 | 3.8 | 3.12 | 732 |
| 89 | B | 2.3 | 40 | 1068 | 0.130 | 0.020 | 0.156 | 990 | 965 | 3.9 | 3.40 | 732 |
| 90 | B | 4.0 | 40 | 1061 | 0.130 | 0.020 | 0.156 | 985 | 950 | 6.7 | 5.50 | 720 |
| 91 | B | 4.0 | 40 | 1051 | 0.130 | 0.020 | 0.156 | 985 | 972 | 6.4 | 5.50 | 720 |
| 92 | B | 4.0 | 40 | 1047 | 0.130 | 0.020 | 0.156 | 987 | 972 | 6.6 | 5.93 | 720 |
| 93 | T | 4.0 | 40 | 1053 | <0.001 | <0.001 | 0 | 992 | 966 | 6.5 | 5.51 | 720 |
| 94 | T | 4.0 | 40 | 1060 | <0.001 | <0.001 | 0 | 991 | 967 | 6.9 | 5.95 | 720 |
| 95 | B | 2.4 | 40 | 1045 | 0.130 | 0.020 | 0.156 | 987 | 973 | 3.9 | 3.06 | 732 |
| 96 | B | 2.3 | 40 | 1055 | 0.130 | 0.020 | 0.156 | 991 | 972 | 3.8 | 3.33 | 732 |
| 97 | B | 2.3 | 40 | 1041 | 0.130 | 0.020 | 0.156 | 990 | 964 | 3.8 | 3.16 | 732 |
| 98 | B | 4.2 | 40 | 1065 | 0.130 | 0.020 | 0.156 | 989 | 967 | 7.2 | 5.72 | 720 |
| 99 | B | 4.1 | 40 | 1071 | 0.130 | 0.020 | 0.156 | 993 | 973 | 7.0 | 6.11 | 720 |
| 100 | B | 4.0 | 40 | 1066 | 0.130 | 0.020 | 0.156 | 987 | 967 | 6.6 | 5.94 | 720 |
| 101 | T | 4.1 | 40 | 1066 | <0.001 | <0.001 | 0 | 993 | 969 | 6.8 | 5.89 | 720 |
| 102 | T | 4.0 | 40 | 1046 | <0.001 | <0.001 | 0 | 986 | 967 | 6.5 | 5.98 | 720 |
| 103 | B | 2.3 | 40 | 886 | 0.130 | 0.020 | 0.156 | 972 | 953 | 3.8 | 3.81 | 732 |
| 104 | J | 2.9 | 40 | 1055 | 0.090 | 0.020 | 0.116 | 988 | 972 | 4.9 | 4.08 | 720 |
| 105 | J | 2.9 | 40 | 1062 | 0.090 | 0.020 | 0.116 | 987 | 973 | 4.6 | 4.36 | 720 |
| 106 | A | 2.9 | 40 | 1044 | 0.120 | 0.018 | 0.143 | 986 | 961 | 4.6 | 4.43 | 720 |
| 107 | K | 2.9 | 40 | 1046 | 0.030 | 0.010 | 0.043 | 993 | 971 | 4.9 | 4.37 | 720 |
| 108 | K | 2.9 | 40 | 1075 | 0.030 | 0.010 | 0.043 | 987 | 964 | 4.6 | 4.40 | 720 |

TABLE 6

| TEST MATERIAL No. | STEEL TYPE | SHEET THICKNESS tf (mm) | SHEET THICKNESS OF ROUGH-ROLLED SHEET (mm) | FINISH ROLLING START TEMPERATURE (° C.) | FINISH ROLLING CONDITIONS Ti (mass %) | Nb (mass %) | Ti + 1.3Nb (mass %) | FT1 (° C.) | FT2 (° C.) | t0 (mm) | t1 (mm) | D1 (mm) |
|---|---|---|---|---|---|---|---|---|---|---|---|---|
| 109 | N | 2.9 | 40 | 1062 | 0.170 | 0.005 | 0.177 | 988 | 954 | 4.7 | 3.93 | 720 |
| 110 | F | 2.9 | 40 | 1050 | 0.140 | 0.010 | 0.153 | 970 | 954 | 4.9 | 3.98 | 720 |
| 111 | C | 2.9 | 40 | 1050 | 0.100 | 0.030 | 0.139 | 988 | 965 | 4.4 | 4.02 | 720 |
| 112 | N | 2.9 | 40 | 1062 | 0.170 | 0.005 | 0.177 | 988 | 951 | 4.7 | 3.93 | 720 |
| 113 | B | 2.9 | 30 | 1083 | 0.130 | 0.020 | 0.156 | 985 | 970 | 4.8 | 4.02 | 720 |
| 114 | B | 2.9 | 37 | 1083 | 0.130 | 0.020 | 0.156 | 980 | 973 | 4.8 | 4.01 | 720 |
| 115 | B | 2.9 | 45 | 1080 | 0.130 | 0.020 | 0.156 | 982 | 971 | 4.8 | 4.01 | 720 |
| 116 | B | 2.9 | 47 | 1079 | 0.130 | 0.020 | 0.156 | 981 | 973 | 4.8 | 4.02 | 720 |
| 117 | G | 2.9 | 40 | 1073 | 0.080 | 0.007 | 0.089 | 1025 | 966 | 4.6 | 4.34 | 720 |
| 118 | G | 2.9 | 40 | 1073 | 0.080 | 0.007 | 0.089 | 990 | 920 | 4.6 | 4.34 | 720 |
| 119 | G | 2.9 | 40 | 1085 | 0.080 | 0.007 | 0.089 | 990 | 1005 | 4.6 | 4.41 | 720 |
| 120 | G | 2.9 | 39 | 1081 | 0.080 | 0.007 | 0.089 | 995 | 966 | 5.1 | 4.74 | 720 |
| 121 | G | 2.9 | 39 | 1079 | 0.080 | 0.007 | 0.089 | 985 | 965 | 4.5 | 3.99 | 720 |
| 122 | G | 2.9 | 39 | 1078 | 0.080 | 0.007 | 0.089 | 989 | 963 | 5.0 | 4.35 | 720 |
| 123 | G | 2.9 | 39 | 990 | 0.080 | 0.007 | 0.089 | 970 | 961 | 5.0 | 4.23 | 720 |
| 124 | AH | 3.0 | 30 | 1250 | 0.021 | <0.001 | 0.021 | 1008 | 993 | 5.6 | 5.00 | 720 |
| 125 | AI | 2.0 | 40 | 1065 | 0.110 | <0.001 | 0.110 | 977 | 962 | 8.0 | 6.67 | 720 |
| 126 | AJ | 1.6 | 38 | 1063 | 0.070 | 0.035 | 0.116 | 903 | 872 | 3.1 | 2.30 | 720 |
| 127 | AK | 2.0 | 30 | 1250 | <0.001 | <0.001 | 0 | 970 | 960 | 7.3 | 5.56 | 720 |
| 128 | AL | 2.9 | 40 | 1050 | 0.090 | 0.020 | 0.116 | 985 | 965 | 4.8 | 4.33 | 720 |

TABLE 7

| TEST MATERIAL No. | STEEL TYPE | FINISH ROLLING CONDITIONS Sr1 | t2 (mm) | D2 (mm) | Sr2 | F1 (%) | F2 (%) | Ft (%) | CALCULATED VALUE USING CONDITIONAL EQUATION FT1* (° C.) | FT2* (° C.) | ω | COOLING AND COILING PATTERN |
|---|---|---|---|---|---|---|---|---|---|---|---|---|
| 1 | A | 4.03 | 3.49 | 805 | 4.99 | 15.0 | 17.0 | 40.4 | 56 | 16 | 58.8 | B |
| 2 | B | 3.80 | 3.49 | 805 | 4.97 | 13.4 | 16.9 | 40.0 | 54 | 13 | 76.8 | B |
| 3 | C | 3.82 | 3.47 | 805 | 4.89 | 13.5 | 16.3 | 39.3 | 62 | 15 | 67.6 | B |
| 4 | D | 4.10 | 3.59 | 805 | 5.33 | 15.9 | 19.3 | 41.5 | 67 | 14 | 58.9 | B |
| 5 | E | 4.11 | 3.66 | 805 | 5.53 | 16.3 | 20.7 | 40.1 | 73 | 23 | 43.1 | B |
| 6 | F | 4.65 | 3.43 | 805 | 4.74 | 19.3 | 15.4 | 40.7 | 60 | 14 | 55.7 | B |
| 7 | G | 4.18 | 3.61 | 805 | 5.40 | 16.7 | 19.8 | 38.1 | 102 | 24 | 35.9 | B |
| 8 | H | 4.67 | 3.45 | 805 | 4.84 | 19.7 | 16.0 | 39.6 | 60 | 16 | 51.4 | Ms |
| 9 | I | 3.90 | 3.44 | 805 | 4.80 | 13.9 | 15.8 | 38.3 | 245 | 62 | 15.7 | Ms |
| 10 | J | 4.05 | 3.39 | 805 | 4.58 | 14.7 | 14.4 | 42.0 | 74 | 18 | 49.8 | B |
| 11 | K | 4.26 | 3.52 | 805 | 5.09 | 16.8 | 17.7 | 41.8 | 260 | 62 | 13.5 | B |
| 12 | L | 3.80 | 3.62 | 805 | 5.42 | 13.9 | 19.9 | 39.5 | 810 | 203 | 5.0 | B |
| 13 | M | 4.93 | 3.43 | 805 | 4.76 | 21.7 | 15.5 | 39.9 | 96 | 27 | 30.2 | B |
| 14 | N | 4.12 | 3.34 | 805 | 4.37 | 15.0 | 13.2 | 38.7 | 47 | 10 | 83.0 | B |
| 15 | O | 4.38 | 3.42 | 805 | 4.71 | 17.3 | 15.2 | 40.5 | 26 | 7 | 117.4 | B |
| 16 | P | 3.85 | 3.50 | 805 | 5.03 | 13.8 | 17.2 | 38.4 | 99 | 26 | 38.5 | B |
| 17 | Q | 4.36 | 3.57 | 805 | 5.25 | 17.8 | 18.7 | 37.9 | 94 | 23 | 36.6 | B |
| 18 | R | 4.27 | 3.53 | 805 | 5.11 | 17.0 | 17.8 | 41.2 | 47 | 10 | 79.0 | B |
| 19 | S | 3.45 | 3.58 | 805 | 5.28 | 11.4 | 18.9 | 37.9 | 22 | 6 | 281.5 | B |
| 20 | U | 3.38 | 3.63 | 805 | 5.44 | 11.1 | 20.0 | 39.8 | 88 | 19 | 75.4 | B |
| 21 | V | 4.76 | 3.45 | 805 | 4.83 | 20.4 | 16.0 | 40.0 | 83 | 21 | 38.0 | B |
| 22 | W | 4.03 | 3.58 | 805 | 5.29 | 15.4 | 19.0 | 39.0 | 84 | 23 | 41.2 | B |
| 23 | X | 4.22 | 3.55 | 805 | 5.18 | 16.6 | 18.2 | 38.3 | 69 | 19 | 46.3 | B |
| 24 | Y | 3.88 | 3.41 | 805 | 4.68 | 13.6 | 15.0 | 40.2 | 71 | 17 | 57.6 | B |
| 25 | Z | 4.23 | 3.40 | 805 | 4.64 | 16.1 | 14.8 | 39.4 | 76 | 18 | 46.0 | B |
| 26 | AA | 4.05 | 3.62 | 805 | 5.41 | 15.7 | 19.8 | 40.1 | 72 | 15 | 55.6 | B |
| 27 | AB | 4.78 | 3.48 | 805 | 4.92 | 20.6 | 16.6 | 39.7 | 58 | 16 | 52.2 | B |
| 28 | AC | 4.20 | 3.53 | 805 | 5.11 | 16.4 | 17.8 | 41.9 | 88 | 23 | 37.7 | B |
| 29 | AD | 4.28 | 3.50 | 805 | 5.00 | 16.9 | 17.0 | 39.3 | 57 | 13 | 62.5 | B |
| 30 | AE | 3.63 | 3.57 | 805 | 5.26 | 12.6 | 18.8 | 38.7 | — | — | — | B |
| 31 | AE | 4.30 | 3.48 | 805 | 4.95 | 17.0 | 16.7 | 41.2 | 103 | 25 | 32.7 | B |
| 32 | AF | 3.90 | 3.46 | 805 | 4.87 | 14.0 | 16.3 | 39.4 | — | — | — | B |
| 33 | AF | 4.43 | 3.53 | 805 | 5.12 | 18.1 | 17.8 | 40.7 | 82 | 23 | 37.8 | B |
| 34 | AG | 4.00 | 4.24 | 805 | 4.22 | 17.8 | 15.2 | 38.5 | 18 | 1 | 486.0 | B |
| 35 | AG | 4.01 | 4.22 | 805 | 4.15 | 17.8 | 14.7 | 38.3 | 34 | 11 | 74.6 | B |
| 36 | A | 4.86 | 2.47 | 805 | 6.40 | 15.4 | 19.1 | 39.3 | 59 | 17 | 66.9 | B |

TABLE 8

| TEST | | FINISH ROLLING CONDITIONS | | | | | | | CALCULATED VALUE USING CONDITIONAL EQUATION | | | COOLING AND |
|---|---|---|---|---|---|---|---|---|---|---|---|---|
| MATERIAL No. | STEEL TYPE | Sr1 | t2 (mm) | D2 (mm) | Sr2 | F1 (%) | F2 (%) | Ft (%) | FT1* (° C.) | FT2* (° C.) | ω | COILING PATTERN |
| 37 | A | 4.51 | 2.67 | 805 | 5.04 | 14.4 | 13.9 | 38.6 | 55 | 16 | 66.9 | B |
| 38 | A | 4.96 | 3.46 | 805 | 4.87 | 22.0 | 16.2 | 40.4 | 56 | 14 | 55.9 | B |
| 39 | A | 4.27 | 4.18 | 805 | 4.02 | 19.9 | 13.8 | 41.9 | 63 | 15 | 45.9 | B |
| 40 | A | 4.04 | 4.73 | 805 | 4.04 | 20.1 | 15.4 | 38.1 | 57 | 16 | 43.8 | B |
| 41 | A | 3.45 | 5.98 | 805 | 3.73 | 18.6 | 16.4 | 41.7 | 63 | 15 | 40.5 | B |
| 42 | A | 4.25 | 3.59 | 760 | 5.17 | 16.2 | 19.2 | 41.8 | 41 | 21 | 57.0 | B |
| 43 | A | 4.99 | 3.56 | 760 | 5.07 | 21.8 | 18.5 | 37.6 | 64 | 13 | 58.6 | B |
| 44 | A | 4.21 | 4.11 | 760 | 4.92 | 18.1 | 19.7 | 42.2 | 44 | 14 | 61.7 | B |
| 45 | A | 4.31 | 3.86 | 760 | 4.19 | 17.9 | 14.5 | 39.6 | 45 | 10 | 70.8 | B |
| 46 | A | 4.20 | 3.47 | 760 | 4.75 | 15.3 | 16.3 | 41.7 | 66 | 23 | 43.2 | Ms |
| 47 | A | 4.81 | 3.50 | 760 | 4.87 | 20.0 | 17.1 | 38.0 | 39 | 9 | 85.7 | Ms |
| 48 | O | 4.81 | 2.69 | 805 | 5.17 | 16.2 | 14.6 | 41.4 | 27 | 6 | 141.5 | B |
| 49 | M | 4.83 | 2.76 | 805 | 5.52 | 16.7 | 16.5 | 41.8 | 96 | 23 | 39.9 | B |
| 50 | N | 5.10 | 2.65 | 805 | 4.94 | 17.8 | 13.3 | 40.9 | 51 | 13 | 69.7 | B |
| 51 | S | 5.30 | 2.66 | 805 | 4.99 | 19.2 | 13.6 | 39.0 | 22 | 5 | 168.4 | B |
| 52 | R | 5.18 | 2.66 | 805 | 4.98 | 18.4 | 13.6 | 40.2 | 47 | 10 | 86.4 | B |
| 53 | Q | 4.57 | 2.91 | 805 | 6.27 | 15.8 | 21.0 | 42.1 | 103 | 26 | 39.7 | B |
| 54 | T | 4.51 | 2.67 | 805 | 5.01 | 14.2 | 13.7 | 39.0 | 828 | 183 | 5.3 | B |
| 55 | B | 4.16 | 2.80 | 805 | 5.74 | 12.7 | 17.8 | 37.8 | 29 | 6 | 196.9 | B |
| 56 | B | 5.35 | 2.78 | 805 | 5.67 | 20.4 | 17.4 | 37.8 | 36 | 11 | 86.8 | B |
| 57 | B | 4.47 | 2.90 | 805 | 6.20 | 15.1 | 20.6 | 38.9 | 40 | 12 | 94.8 | B |
| 58 | B | 4.07 | 4.80 | 805 | 4.22 | 20.7 | 16.7 | 41.3 | 25 | 5 | 125.2 | B |
| 59 | B | 3.94 | 4.95 | 805 | 4.53 | 20.0 | 19.2 | 39.7 | 38 | 9 | 75.7 | B |
| 60 | B | 3.85 | 4.83 | 805 | 4.27 | 18.7 | 17.2 | 41.6 | 41 | 13 | 59.7 | B |
| 61 | T | 3.60 | 4.88 | 805 | 4.37 | 16.6 | 18.0 | 39.1 | 500 | 41 | 13.2 | B |
| 62 | T | 4.09 | 4.72 | 805 | 4.03 | 20.6 | 15.3 | 40.8 | 620 | 119 | 5.2 | B |
| 63 | B | 3.82 | 2.75 | 805 | 5.47 | 10.6 | 16.2 | 38.5 | 54 | 5 | 190.6 | B |
| 64 | B | 4.62 | 2.70 | 805 | 5.23 | 15.0 | 14.9 | 41.6 | 55 | 8 | 97.5 | B |
| 65 | B | 4.31 | 2.69 | 805 | 5.14 | 13.1 | 14.4 | 42.2 | 52 | 12 | 93.4 | B |
| 66 | B | 3.47 | 4.92 | 805 | 4.48 | 15.7 | 18.8 | 39.5 | 57 | 4 | 139.2 | B |
| 67 | B | 4.01 | 4.89 | 805 | 4.41 | 20.4 | 18.2 | 41.6 | 53 | 9 | 69.1 | B |
| 68 | B | 3.17 | 5.03 | 805 | 4.68 | 13.4 | 20.4 | 39.0 | 55 | 11 | 76.1 | B |
| 69 | T | 3.86 | 4.87 | 805 | 4.37 | 19.0 | 17.9 | 40.5 | 831 | 103 | 5.5 | B |
| 70 | T | 3.66 | 4.81 | 805 | 4.22 | 17.0 | 16.8 | 41.5 | 768 | 150 | 4.4 | B |
| 71 | B | 5.71 | 2.74 | 805 | 5.46 | 11.5 | 16.2 | 38.1 | 57 | 14 | 120.0 | B |
| 72 | B | 5.09 | 2.60 | 805 | 4.60 | 16.0 | 11.6 | 40.7 | 53 | 14 | 85.6 | B |

TABLE 9

| TEST | | FINISH ROLLING CONDITIONS | | | | | | | CALCULATED VALUE USING CONDITIONAL EQUATION | | | COOLING AND |
|---|---|---|---|---|---|---|---|---|---|---|---|---|
| MATERIAL No. | STEEL TYPE | Sr1 | t2 (mm) | D2 (mm) | Sr2 | F1 (%) | F2 (%) | Ft (%) | FT1* (° C.) | FT2* (° C.) | ω | COILING PATTERN |
| 73 | B | 4.90 | 2.65 | 805 | 4.91 | 17.2 | 13.2 | 37.8 | 60 | 15 | 61.4 | B |
| 74 | B | 4.12 | 4.94 | 805 | 4.52 | 10.8 | 19.1 | 40.3 | 47 | 9 | 138.9 | B |
| 75 | B | 3.82 | 4.84 | 805 | 4.30 | 16.7 | 17.4 | 40.9 | 52 | 15 | 51.8 | B |
| 76 | B | 3.77 | 4.85 | 805 | 4.31 | 18.6 | 17.5 | 40.3 | 55 | 14 | 49.1 | B |
| 77 | T | 3.43 | 4.88 | 805 | 4.37 | 13.7 | 18.0 | 37.8 | 804 | 186 | 4.6 | B |
| 78 | T | 3.10 | 4.96 | 805 | 4.55 | 13.1 | 19.4 | 39.9 | 780 | 208 | 5.0 | B |
| 79 | B | 4.01 | 2.71 | 2000 | 8.32 | 11.5 | 15.2 | 37.9 | 55 | 15 | 138.2 | B |
| 80 | B | 4.49 | 2.74 | 800 | 5.41 | 14.4 | 16.0 | 40.8 | 54 | 15 | 72.0 | B |
| 81 | B | 4.41 | 2.73 | 700 | 5.02 | 13.9 | 15.7 | 38.1 | 53 | 15 | 70.8 | B |
| 82 | B | 2.98 | 4.97 | 2000 | 7.21 | 11.8 | 19.6 | 38.1 | 57 | 12 | 133.4 | B |
| 83 | B | 3.85 | 4.77 | 800 | 4.13 | 18.5 | 16.2 | 38.4 | 51 | 11 | 57.6 | B |
| 84 | B | 3.67 | 4.95 | 700 | 4.22 | 17.5 | 19.2 | 39.7 | 54 | 14 | 51.2 | B |
| 85 | T | 3.90 | 4.75 | 800 | 4.08 | 18.9 | 15.8 | 41.6 | 787 | 183 | 3.6 | B |
| 86 | T | 3.70 | 4.83 | 700 | 3.98 | 17.3 | 17.1 | 41.5 | 774 | 202 | 3.4 | B |
| 87 | B | 4.14 | 2.68 | 805 | 5.08 | 12.1 | 14.1 | 41.1 | 52 | 15 | 114.3 | B |
| 88 | B | 4.48 | 2.68 | 805 | 5.11 | 14.1 | 14.3 | 39.9 | 56 | 14 | 75.2 | B |
| 89 | B | 5.11 | 2.77 | 805 | 5.59 | 18.6 | 16.9 | 40.4 | 55 | 13 | 69.8 | B |
| 90 | B | 3.83 | 4.54 | 805 | 3.52 | 17.5 | 11.8 | 40.4 | 51 | 7 | 101.2 | B |
| 91 | B | 3.53 | 4.65 | 805 | 3.85 | 15.3 | 14.1 | 37.5 | 52 | 15 | 53.6 | B |
| 92 | B | 3.58 | 4.94 | 805 | 4.51 | 16.7 | 19.1 | 39.8 | 53 | 15 | 52.1 | B |
| 93 | T | 3.37 | 4.72 | 805 | 4.02 | 14.2 | 15.3 | 38.3 | 824 | 190 | 4.2 | B |
| 94 | T | 3.95 | 4.79 | 805 | 4.18 | 19.5 | 16.5 | 41.8 | 809 | 197 | 3.4 | B |
| 95 | B | 3.75 | 2.75 | 805 | 4.70 | 10.2 | 12.7 | 38.6 | 53 | 16 | 116.5 | B |
| 96 | B | 5.42 | 2.66 | 805 | 4.81 | 20.1 | 12.8 | 38.8 | 56 | 15 | 61.5 | B |
| 97 | B | 4.22 | 2.75 | 805 | 5.50 | 12.8 | 16.4 | 39.4 | 55 | 12 | 95.2 | B |

TABLE 9-continued

| TEST | | FINISH ROLLING CONDITIONS | | | | | | | CALCULATED VALUE USING CONDITIONAL EQUATION | | | COOLING AND |
|---|---|---|---|---|---|---|---|---|---|---|---|---|
| MATERIAL No. | STEEL TYPE | Sr1 | t2 (mm) | D2 (mm) | Sr2 | F1 (%) | F2 (%) | Ft (%) | FT1* (° C.) | FT2* (° C.) | ω | COILING PATTERN |
| 98 | B | 3.78 | 4.71 | 805 | 3.20 | 17.6 | 10.4 | 41.4 | 54 | 13 | 220.0 | B |
| 99 | B | 3.88 | 4.93 | 805 | 4.17 | 19.4 | 16.8 | 41.5 | 57 | 15 | 44.9 | B |
| 100 | B | 3.53 | 4.97 | 805 | 4.57 | 16.4 | 19.5 | 39.5 | 53 | 13 | 56.3 | B |
| 101 | T | 3.80 | 4.82 | 805 | 3.91 | 18.2 | 14.9 | 39.5 | 826 | 205 | 3.3 | B |
| 102 | T | 3.71 | 4.92 | 805 | 4.46 | 17.8 | 18.7 | 38.8 | 759 | 197 | 3.7 | B |
| 103 | B | 6.56 | 2.70 | 805 | 5.21 | 29.1 | 14.8 | 39.2 | 42 | 8 | 97.7 | B |
| 104 | J | 3.60 | 3.58 | 805 | 5.28 | 12.4 | 18.9 | 40.4 | 74 | 21 | 69.4 | F + B |
| 105 | J | 4.69 | 3.49 | 805 | 4.98 | 20.0 | 16.9 | 37.6 | 73 | 21 | 39.7 | Ms |
| 106 | A | 4.40 | 3.62 | 805 | 5.42 | 18.4 | 19.9 | 37.6 | 57 | 12 | 65.8 | Ms |
| 107 | K | 4.84 | 3.45 | 805 | 4.84 | 21.0 | 16.0 | 40.6 | 252 | 65 | 12.3 | F + B |
| 108 | K | 4.44 | 3.59 | 805 | 5.32 | 18.5 | 19.2 | 37.6 | 232 | 54 | 15.2 | Ms |

TABLE 10

| TEST | | FINISH ROLLING CONDITIONS | | | | | | | CALCULATED VALUE USING CONDITIONAL EQUATION | | | COOLING AND |
|---|---|---|---|---|---|---|---|---|---|---|---|---|
| MATERIAL No. | STEEL TYPE | Sr1 | t2 (mm) | D2 (mm) | Sr2 | F1 (%) | F2 (%) | Ft (%) | FT1* (° C.) | FT2* (° C.) | ω | COILING PATTERN |
| 109 | N | 4.12 | 3.34 | 805 | 4.37 | 15.0 | 13.2 | 38.7 | 47 | 8 | 98.7 | B |
| 110 | F | 3.91 | 3.43 | 805 | 4.74 | 13.9 | 15.4 | 40.7 | 42 | 9 | 99.3 | B |
| 111 | C | 3.87 | 3.47 | 805 | 4.89 | 13.8 | 16.3 | 34.0 | 60 | 14 | 66.7 | B |
| 112 | N | 4.12 | 3.34 | 805 | 4.37 | 15.0 | 13.2 | 38.7 | 47 | 7 | 107.5 | B |
| 113 | B | 3.81 | 3.48 | 805 | 4.94 | 13.4 | 16.7 | 40.0 | 51 | 14 | 75.6 | B |
| 114 | B | 3.95 | 3.44 | 805 | 4.79 | 14.2 | 15.7 | 39.8 | 48 | 15 | 68.4 | B |
| 115 | B | 3.90 | 3.45 | 805 | 4.83 | 14.0 | 15.9 | 39.8 | 49 | 15 | 70.9 | B |
| 116 | B | 4.14 | 3.40 | 805 | 4.63 | 15.4 | 14.7 | 39.8 | 49 | 15 | 62.0 | B |
| 117 | G | 4.17 | 3.62 | 805 | 5.42 | 16.6 | 19.9 | 36.3 | 145 | 24 | 32.5 | B |
| 118 | G | 4.17 | 3.62 | 805 | 5.42 | 16.6 | 19.9 | 36.3 | — | — | — | B |
| 119 | G | 4.38 | 3.61 | 805 | 5.39 | 18.1 | 19.7 | 37.4 | 101 | 49 | 22.8 | B |
| 120 | G | 5.09 | 3.60 | 805 | 5.36 | 24.0 | 19.4 | 42.6 | 107 | 24 | 33.0 | B |
| 121 | G | 4.71 | 3.24 | 805 | 3.88 | 18.8 | 10.5 | 35.7 | 95 | 23 | 130.0 | B |
| 122 | G | 3.48 | 3.82 | 805 | 5.99 | 12.3 | 24.0 | 41.4 | 100 | 22 | 60.8 | B |
| 123 | G | 4.70 | 3.40 | 805 | 4.63 | 19.6 | 14.7 | 41.4 | 76 | 21 | 39.1 | B |
| 124 | AH | 5.09 | 3.75 | 805 | 5.35 | 25.0 | 20.0 | 46.7 | 891 | 295 | 3.0 | Ms |
| 125 | AI | 7.79 | 3.34 | 805 | 9.48 | 50.0 | 40.0 | 75.0 | 67 | 17 | 81.0 | Ms |
| 126 | AJ | 6.46 | 1.84 | 805 | 5.85 | 20.0 | 13.0 | 48.4 | — | — | — | F + B |
| 127 | AK | 6.94 | 3.34 | 805 | 9.48 | 40.0 | 40.0 | 72.6 | 600 | 160 | 8.5 | F + B |
| 128 | AL | 4.79 | 3.44 | 805 | 4.79 | 20.6 | 15.7 | 40.0 | 71 | 17 | 44.9 | B |

TABLE 11

| | | TEXTURE | | MECHANICAL PROPERTIES | | | |
|---|---|---|---|---|---|---|---|
| TEST MATERIAL No. | STEEL TYPE | SURFACE REGION SUM A OF POLE DENSITIES | INTERNAL REGION SUM B OF POLE DENSITIES | TENSILE STRENGTH TS (MPa) | TOTAL ELONGATION EL (%) | CRITICAL BENDING R/t | INVENTIVE or COMPARATIVE |
| 1 | A | 5.1 | 5.9 | 1046 | 14 | 1.4 | INVENTIVE EXAMPLE |
| 2 | B | 5.5 | 6.7 | 1055 | 12 | 1.7 | INVENTIVE EXAMPLE |
| 3 | C | 5.2 | 6.0 | 1020 | 12 | 1.6 | INVENTIVE EXAMPLE |
| 4 | D | 4.9 | 5.1 | 1111 | 18 | 1.8 | INVENTIVE EXAMPLE |
| 5 | E | 5.6 | 5.4 | 769 | 21 | 1.4 | COMPARATIVE EXAMPLE |
| 6 | F | 4.4 | 5.5 | 986 | 14 | 0.9 | INVENTIVE EXAMPLE |
| 7 | G | 3.7 | 4.9 | 1185 | 12 | 0.8 | INVENTIVE EXAMPLE |
| 8 | H | 4.0 | 5.3 | 1271 | 8 | 3.0 | COMPARATIVE EXAMPLE |
| 9 | I | 2.3 | 4.0 | 777 | 14 | 0.1 | COMPARATIVE EXAMPLE |
| 10 | J | 5.0 | 5.8 | 802 | 21 | 0.7 | INVENTIVE EXAMPLE |
| 11 | K | 2.8 | 4.1 | 1142 | 12 | 1.0 | INVENTIVE EXAMPLE |
| 12 | L | 1.9 | 3.8 | 925 | 16 | 0.4 | INVENTIVE EXAMPLE |
| 13 | M | 3.6 | 4.8 | 989 | 14 | 0.8 | INVENTIVE EXAMPLE |

TABLE 11-continued

| TEST MATERIAL No. | STEEL TYPE | TEXTURE SURFACE REGION SUM A OF POLE DENSITIES | TEXTURE INTERNAL REGION SUM B OF POLE DENSITIES | MECHANICAL PROPERTIES TENSILE STRENGTH TS (MPa) | MECHANICAL PROPERTIES TOTAL ELONGATION EL (%) | MECHANICAL PROPERTIES CRITICAL BENDING R/t | INVENTIVE or COMPARATIVE |
|---|---|---|---|---|---|---|---|
| 14 | N | 5.9 | 6.3 | 1088 | 12 | 1.7 | INVENTIVE EXAMPLE |
| 15 | O | 6.2 | 7.2 | 1101 | 11 | 2.3 | COMPARATIVE EXAMPLE |
| 16 | P | 3.2 | 5.0 | 944 | 16 | 0.5 | INVENTIVE EXAMPLE |
| 17 | Q | 4.0 | 4.8 | 1018 | 14 | 0.6 | INVENTIVE EXAMPLE |
| 18 | R | 5.6 | 6.4 | 1043 | 12 | 1.5 | INVENTIVE EXAMPLE |
| 19 | S | 7.8 | 7.4 | 978 | 8 | 2.8 | COMPARATIVE EXAMPLE |
| 20 | U | 5.9 | 6.3 | 1028 | 15 | 1.7 | INVENTIVE EXAMPLE |
| 21 | V | 4.4 | 5.2 | 1103 | 12 | 0.7 | INVENTIVE EXAMPLE |
| 22 | W | 4.6 | 5.4 | 1161 | 11 | 1.3 | INVENTIVE EXAMPLE |
| 23 | X | 4.8 | 5.3 | 1053 | 12 | 1.0 | INVENTIVE EXAMPLE |
| 24 | Y | 4.5 | 6.7 | 1075 | 12 | 1.4 | INVENTIVE EXAMPLE |
| 25 | Z | 5.0 | 4.5 | 1054 | 12 | 0.9 | INVENTIVE EXAMPLE |
| 26 | AA | 5.1 | 5.7 | 1001 | 16 | 1.1 | INVENTIVE EXAMPLE |
| 27 | AB | 4.1 | 5.4 | 1101 | 12 | 0.7 | INVENTIVE EXAMPLE |
| 28 | AC | 4.5 | 4.6 | 1065 | 13 | 0.6 | INVENTIVE EXAMPLE |
| 29 | AD | 4.1 | 5.4 | 1091 | 13 | 1.2 | INVENTIVE EXAMPLE |
| 30 | AE | 7.3 | 8.7 | 802 | 18 | 2.6 | COMPARATIVE EXAMPLE |
| 31 | AE | 4.3 | 4.3 | 823 | 17 | 0.3 | INVENTIVE EXAMPLE |
| 32 | AF | 6.2 | 7.8 | 935 | 15 | 2.3 | COMPARATIVE EXAMPLE |
| 33 | AF | 4.1 | 5.0 | 956 | 16 | 1.4 | INVENTIVE EXAMPLE |
| 34 | AG | 6.3 | 9.1 | 1000 | 16 | 2.3 | COMPARATIVE EXAMPLE |
| 35 | AG | 5.7 | 6.5 | 1002 | 16 | 1.3 | INVENTIVE EXAMPLE |
| 36 | A | 5.4 | 6.2 | 1056 | 12 | 1.5 | INVENTIVE EXAMPLE |

TABLE 12

| TEST MATERIAL No. | STEEL TYPE | TEXTURE SURFACE REGION SUM A OF POLE DENSITIES | TEXTURE INTERNAL REGION SUM B OF POLE DENSITIES | MECHANICAL PROPERTIES TENSILE STRENGTH TS (MPa) | MECHANICAL PROPERTIES TOTAL ELONGATION EL (%) | MECHANICAL PROPERTIES CRITICAL BENDING R/t | INVENTIVE or COMPARATIVE |
|---|---|---|---|---|---|---|---|
| 37 | A | 5.8 | 6.0 | 1051 | 11 | 1.4 | INVENTIVE EXAMPLE |
| 38 | A | 5.2 | 6.2 | 1056 | 13 | 1.3 | INVENTIVE EXAMPLE |
| 39 | A | 5.4 | 4.7 | 1061 | 16 | 0.6 | INVENTIVE EXAMPLE |
| 40 | A | 4.4 | 5.2 | 1061 | 14 | 0.8 | INVENTIVE EXAMPLE |
| 41 | A | 4.8 | 5.3 | 1055 | 14 | 0.8 | INVENTIVE EXAMPLE |
| 42 | A | 4.5 | 4.9 | 1021 | 16 | 0.8 | INVENTIVE EXAMPLE |
| 43 | A | 5.8 | 5.7 | 1057 | 15 | 1.7 | INVENTIVE EXAMPLE |
| 44 | A | 5.8 | 5.2 | 1044 | 16 | 0.9 | INVENTIVE EXAMPLE |
| 45 | A | 5.7 | 5.5 | 1067 | 12 | 1.5 | INVENTIVE EXAMPLE |
| 46 | A | 2.3 | 4.1 | 1197 | 9 | 1.3 | INVENTIVE EXAMPLE |
| 47 | A | 5.7 | 5.2 | 1198 | 11 | 1.7 | INVENTIVE EXAMPLE |
| 48 | O | 6.9 | 7.5 | 1109 | 9 | 2.4 | COMPARATIVE EXAMPLE |
| 49 | M | 5.1 | 5.4 | 993 | 14 | 1.1 | INVENTIVE EXAMPLE |
| 50 | N | 4.7 | 6.1 | 1092 | 12 | 1.5 | INVENTIVE EXAMPLE |
| 51 | S | 6.3 | 7.1 | 991 | 9 | 2.3 | COMPARATIVE EXAMPLE |
| 52 | R | 5.3 | 6.2 | 1043 | 10 | 1.7 | INVENTIVE EXAMPLE |
| 53 | Q | 4.2 | 4.6 | 1022 | 11 | 0.9 | INVENTIVE EXAMPLE |
| 54 | T | 2.3 | 3.8 | 826 | 18 | 0.3 | INVENTIVE EXAMPLE |
| 55 | B | 7.0 | 7.7 | 1021 | 11 | 2.4 | COMPARATIVE EXAMPLE |
| 56 | B | 5.5 | 6.4 | 1055 | 11 | 1.7 | INVENTIVE EXAMPLE |
| 57 | B | 5.6 | 6.5 | 1074 | 12 | 1.7 | INVENTIVE EXAMPLE |
| 58 | B | 7.0 | 7.2 | 1036 | 12 | 2.6 | COMPARATIVE EXAMPLE |
| 59 | B | 5.1 | 6.6 | 1066 | 14 | 1.6 | INVENTIVE EXAMPLE |
| 60 | B | 4.5 | 5.2 | 1062 | 12 | 1.1 | INVENTIVE EXAMPLE |
| 61 | T | 3.1 | 4.4 | 819 | 21 | 0.4 | INVENTIVE EXAMPLE |
| 62 | T | 1.8 | 4.1 | 834 | 20 | 0.3 | INVENTIVE EXAMPLE |
| 63 | B | 6.3 | 8.3 | 1027 | 11 | 2.4 | COMPARATIVE EXAMPLE |
| 64 | B | 5.7 | 6.8 | 1040 | 12 | 1.7 | INVENTIVE EXAMPLE |
| 65 | B | 5.6 | 6.2 | 1018 | 14 | 1.3 | INVENTIVE EXAMPLE |
| 66 | B | 6.2 | 7.1 | 1066 | 12 | 2.4 | COMPARATIVE EXAMPLE |
| 67 | B | 3.7 | 6.4 | 1045 | 13 | 1.5 | INVENTIVE EXAMPLE |
| 68 | B | 4.8 | 6.3 | 1018 | 14 | 1.5 | INVENTIVE EXAMPLE |

TABLE 12-continued

| TEST MATERIAL No. | STEEL TYPE | TEXTURE: SURFACE REGION SUM A OF POLE DENSITIES | TEXTURE: INTERNAL REGION SUM B OF POLE DENSITIES | MECHANICAL PROPERTIES: TENSILE STRENGTH TS (MPa) | MECHANICAL PROPERTIES: TOTAL ELONGATION EL (%) | MECHANICAL PROPERTIES: CRITICAL BENDING R/t | INVENTIVE or COMPARATIVE |
|---|---|---|---|---|---|---|---|
| 69 | T | 3.1 | 4.5 | 837 | 20 | 0.3 | INVENTIVE EXAMPLE |
| 70 | T | 3.0 | 4.2 | 814 | 20 | 0.2 | INVENTIVE EXAMPLE |
| 71 | B | 6.2 | 7.7 | 1055 | 12 | 2.5 | COMPARATIVE EXAMPLE |
| 72 | B | 4.0 | 6.6 | 1051 | 14 | 1.3 | INVENTIVE EXAMPLE |

TABLE 13

| TEST MATERIAL No. | STEEL TYPE | TEXTURE: SURFACE REGION SUM A OF POLE DENSITIES | TEXTURE: INTERNAL REGION SUM B OF POLE DENSITIES | MECHANICAL PROPERTIES: TENSILE STRENGTH TS (MPa) | MECHANICAL PROPERTIES: TOTAL ELONGATION EL (%) | MECHANICAL PROPERTIES: CRITICAL BENDING R/t | INVENTIVE or COMPARATIVE |
|---|---|---|---|---|---|---|---|
| 73 | B | 5.7 | 5.8 | 1024 | 13 | 1.7 | INVENTIVE EXAMPLE |
| 74 | B | 6.3 | 7.2 | 1036 | 10 | 2.4 | COMPARATIVE EXAMPLE |
| 75 | B | 5.1 | 5.2 | 1031 | 13 | 1.1 | INVENTIVE EXAMPLE |
| 76 | B | 5.4 | 5.6 | 1041 | 13 | 1.1 | INVENTIVE EXAMPLE |
| 77 | T | 3.2 | 4.5 | 826 | 20 | 0.2 | INVENTIVE EXAMPLE |
| 78 | T | 3.7 | 4.6 | 831 | 19 | 0.3 | INVENTIVE EXAMPLE |
| 79 | B | 6.1 | 7.4 | 1048 | 12 | 2.3 | COMPARATIVE EXAMPLE |
| 80 | B | 5.8 | 6.2 | 1041 | 13 | 1.5 | INVENTIVE EXAMPLE |
| 81 | B | 4.7 | 5.7 | 1062 | 14 | 1.7 | INVENTIVE EXAMPLE |
| 82 | B | 6.3 | 7.7 | 1059 | 13 | 2.4 | COMPARATIVE EXAMPLE |
| 83 | B | 3.9 | 5.9 | 1046 | 12 | 0.9 | INVENTIVE EXAMPLE |
| 84 | B | 4.2 | 5.2 | 1028 | 13 | 1.0 | INVENTIVE EXAMPLE |
| 85 | T | 1.5 | 4.4 | 815 | 20 | 0.3 | INVENTIVE EXAMPLE |
| 86 | T | 1.9 | 4.6 | 834 | 19 | 0.2 | INVENTIVE EXAMPLE |
| 87 | B | 6.8 | 7.6 | 1063 | 11 | 2.9 | COMPARATIVE EXAMPLE |
| 88 | B | 4.5 | 5.9 | 1044 | 12 | 1.5 | INVENTIVE EXAMPLE |
| 89 | B | 3.7 | 6.4 | 1061 | 13 | 1.3 | INVENTIVE EXAMPLE |
| 90 | B | 5.6 | 7.1 | 1058 | 11 | 1.9 | INVENTIVE EXAMPLE |
| 91 | B | 4.6 | 5.9 | 1053 | 13 | 0.9 | INVENTIVE EXAMPLE |
| 92 | B | 5.6 | 5.1 | 1028 | 14 | 1.0 | INVENTIVE EXAMPLE |
| 93 | T | 2.4 | 4.3 | 819 | 21 | 0.4 | INVENTIVE EXAMPLE |
| 94 | T | 1.8 | 5.1 | 832 | 18 | 0.4 | INVENTIVE EXAMPLE |
| 95 | B | 6.7 | 8.0 | 1076 | 10 | 2.9 | COMPARATIVE EXAMPLE |
| 96 | B | 5.0 | 5.7 | 1050 | 13 | 1.4 | INVENTIVE EXAMPLE |
| 97 | B | 5.3 | 6.4 | 1066 | 13 | 1.5 | INVENTIVE EXAMPLE |
| 98 | B | 6.8 | 8.0 | 1048 | 12 | 2.9 | COMPARATIVE EXAMPLE |
| 99 | B | 4.5 | 5.7 | 1034 | 12 | 0.7 | INVENTIVE EXAMPLE |
| 100 | B | 4.7 | 6.3 | 1031 | 15 | 0.8 | INVENTIVE EXAMPLE |
| 101 | T | 2.8 | 4.6 | 836 | 18 | 0.5 | INVENTIVE EXAMPLE |
| 102 | T | 3.5 | 4.4 | 819 | 20 | 0.6 | INVENTIVE EXAMPLE |
| 103 | B | 6.5 | 6.8 | 1100 | 8 | 2.3 | COMPARATIVE EXAMPLE |
| 104 | J | 5.8 | 6.7 | 783 | 25 | 0.9 | INVENTIVE EXAMPLE |
| 105 | J | 4.5 | 5.7 | 972 | 10 | 1.0 | INVENTIVE EXAMPLE |
| 106 | A | 4.5 | 5.8 | 1204 | 9 | 1.6 | INVENTIVE EXAMPLE |
| 107 | K | 4.3 | 4.7 | 1106 | 13 | 0.8 | INVENTIVE EXAMPLE |
| 108 | K | 4.1 | 5.1 | 1272 | 7 | 1.0 | INVENTIVE EXAMPLE |

TABLE 14

| TEST MATERIAL No. | STEEL TYPE | TEXTURE: SURFACE REGION SUM A OF POLE DENSITIES | TEXTURE: INTERNAL REGION SUM B OF POLE DENSITIES | MECHANICAL PROPERTIES: TENSILE STRENGTH TS (MPa) | MECHANICAL PROPERTIES: TOTAL ELONGATION EL (%) | MECHANICAL PROPERTIES: CRITICAL BENDING R/t | INVENTIVE or COMPARATIVE |
|---|---|---|---|---|---|---|---|
| 109 | N | 5.8 | 7.1 | 1095 | 11 | 2.0 | INVENTIVE EXAMPLE |
| 110 | F | 4.5 | 7.2 | 995 | 13 | 2.0 | INVENTIVE EXAMPLE |
| 111 | C | 6.3 | 7.3 | 1015 | 13 | 2.3 | COMPARATIVE EXAMPLE |
| 112 | N | 5.9 | 7.2 | 1093 | 11 | 1.9 | INVENTIVE EXAMPLE |
| 113 | B | 6.3 | 7.2 | 1058 | 12 | 2.3 | COMPARATIVE EXAMPLE |
| 114 | B | 5.4 | 6.6 | 1053 | 12 | 1.7 | INVENTIVE EXAMPLE |
| 115 | B | 5.5 | 6.5 | 1055 | 12 | 1.7 | INVENTIVE EXAMPLE |
| 116 | B | 6.5 | 7.1 | 1060 | 11 | 2.4 | COMPARATIVE EXAMPLE |
| 117 | G | 6.2 | 7.3 | 1189 | 11 | 2.3 | COMPARATIVE EXAMPLE |
| 118 | G | 7.8 | 8.2 | 1195 | 11 | 2.8 | COMPARATIVE EXAMPLE |
| 119 | G | 7.7 | 8.2 | 1193 | 12 | 2.6 | COMPARATIVE EXAMPLE |
| 120 | G | 7.4 | 8.0 | 1186 | 12 | 2.3 | COMPARATIVE EXAMPLE |
| 121 | G | 8.1 | 8.6 | 1200 | 10 | 2.8 | COMPARATIVE EXAMPLE |
| 122 | G | 7.5 | 7.9 | 1190 | 11 | 2.3 | COMPARATIVE EXAMPLE |
| 123 | G | 6.4 | 7.5 | 1183 | 11 | 2.4 | COMPARATIVE EXAMPLE |
| 124 | AH | 6.8 | 7.1 | 970 | 13 | 2.3 | COMPARATIVE EXAMPLE |
| 125 | AI | 6.5 | 7.2 | 1205 | 7 | 2.6 | COMPARATIVE EXAMPLE |
| 126 | AJ | 8.3 | 8.6 | 981 | 8 | 2.8 | COMPARATIVE EXAMPLE |
| 127 | AK | 6.8 | 7.0 | 1015 | 21 | 2.6 | COMPARATIVE EXAMPLE |
| 128 | AL | 4.5 | 5.3 | 1130 | 12 | 0.8 | INVENTIVE EXAMPLE |

INDUSTRIAL APPLICABILITY

According to the above aspects of the present invention, it is possible to obtain a hot-rolled steel sheet having a tensile strength (maximum tensile strength) of 780 MPa or more and excellent bending workability in which the initiation of inner bending crack is suppressed. Accordingly, the present invention has significant industrial applicability.

What is claimed is:

1. A hot-rolled steel sheet comprising: as a chemical composition, by mass%, 0.030 to 0.400% of C;
0.050 to 2.5% of Si;
1.00 to 4.00% of Mn;
0.001 to 2.0% of sol.Al;
0 to 0.20% of Ti;
0 to 0.20% of Nb;
0 to 0.010% of B;
0 to 1.0% of V;
0 to 1.0% of Cr;
0 to 1.0% of Mo;
0 to 1.0% of Cu;
0 to 1.0% of Co;
0 to 1.0% of W;
0 to 1.0% of Ni;
0 to 0.01% of Ca;
0 to 0.01% of Mg;
0 to 0.01% of REM;
0 to 0.01% of Zr;
limited to 0.020% or less of P;
limited to 0.020% or less of S;
limited to 0.010% or less of N; and
a balance comprising Fe and impurities, and
wherein, when a surface region is from a sheet surface to 1/10 of a sheet thickness, a sum of an average of pole densities in a crystal orientation group comprising {211}<111> to {111}<112>and a pole density in a crystal orientation of {110}<001>is 0.5 to 6.0 in the surface region, and
wherein a tensile strength is 780 to 1370 MPa.

2. The hot-rolled steel sheet according to claim 1, wherein, when an internal region is from 1/8 to 3/8 of the sheet thickness based on the sheet surface, a sum of a pole density in a crystal orientation of {332}<113>and a pole density in a crystal orientation of {110}<001>is 1.0 to 7.0 in the internal region.

3. The hot-rolled steel sheet according to claim 1, the hot-rolled steel sheet comprising, as the chemical composition, by mass %, at least one of:

0.001 to 0.20% of Ti;
0.001 to 0.20% of Nb;
0.001 to 0.010% of B;
0.005 to 1.0% of V;
0.005 to 1.0% of Cr;
0.005 to 1.0% of Mo;
0.005 to 1.0% of Cu;
0.005 to 1.0% of Co;
0.005 to 1.0% of W;
0.005 to 1.0% of Ni;
0.0003 to 0.01% of Ca;
0.0003 to 0.01% of Mg;
0.0003 to 0.01% of REM; and
0.0003 to 0.01% of Zr.

4. The hot-rolled steel sheet according to claim 2, the hot-rolled steel sheet comprising, as the chemical composition, by mass %, at least one of:

0.001 to 0.20% of Ti;
0.001 to 0.20% of Nb;
0.001 to 0.010% of B;
0.005 to 1.0% of V;
0.005 to 1.0% of Cr;
0.005 to 1.0% of Mo;
0.005 to 1.0% of Cu;
0.005 to 1.0% of Co;
0.005 to 1.0% of W;
0.005 to 1.0% of Ni;
0.0003 to 0.01% of Ca;
0.0003 to 0.01% of Mg;

0.0003 to 0.01% of REM; and
0.0003 to 0.01% of Zr.

* * * * *